US009943739B2

(12) United States Patent
Hart

(10) Patent No.: US 9,943,739 B2
(45) Date of Patent: Apr. 17, 2018

(54) SPIN INDUCING ARM PITCHING MACHINE

(71) Applicant: Thomas Hart, Fenton, MO (US)

(72) Inventor: Thomas Hart, Fenton, MO (US)

( * ) Notice: Subject to any disclaimer, the term of this patent is extended or adjusted under 35 U.S.C. 154(b) by 0 days.

(21) Appl. No.: 15/000,042

(22) Filed: Jan. 19, 2016

(65) Prior Publication Data

US 2016/0250536 A1 Sep. 1, 2016

Related U.S. Application Data

(60) Provisional application No. 62/098,698, filed on Dec. 31, 2014.

(51) Int. Cl.

| | |
|---|---|
| ***F41B 3/03*** | (2006.01) |
| ***A63B 69/00*** | (2006.01) |
| ***A63B 69/40*** | (2006.01) |
| ***A63B 71/06*** | (2006.01) |
| *A63B 102/02* | (2015.01) |
| *A63B 102/18* | (2015.01) |

(52) U.S. Cl.

CPC ..... *A63B 69/0002* (2013.01); *A63B 69/40* (2013.01); *A63B 69/406* (2013.01); *A63B 69/408* (2013.01); *A63B 71/0622* (2013.01); *F41B 3/03* (2013.01); *A63B 69/0053* (2013.01); *A63B 2069/0008* (2013.01); *A63B 2069/0011* (2013.01); *A63B 2069/401* (2013.01); *A63B 2069/402* (2013.01); *A63B 2071/065* (2013.01); *A63B 2071/0675* (2013.01); *A63B 2071/0694* (2013.01); *A63B 2102/02* (2015.10); *A63B 2102/18* (2015.10); *A63B 2102/182* (2015.10); *A63B 2207/02* (2013.01); *A63B 2225/09* (2013.01); *A63B 2225/093* (2013.01); *A63B 2225/50* (2013.01); *A63B 2243/0025* (2013.01)

(58) Field of Classification Search

CPC ..... A63B 69/408; F41B 3/03

See application file for complete search history.

(56) References Cited

U.S. PATENT DOCUMENTS 2,696,204 A * 12/1954 Gilgoff ..... A63B 69/408 124/41.1
3,172,401 A * 3/1965 Pullen ..... A63H 13/10 124/7
3,406,674 A * 10/1968 Zone ..... A63B 69/408 124/36

(Continued)

*Primary Examiner* — John Ricci

(74) *Attorney, Agent, or Firm* — Creativenture Law, LLC; Dennis JM Donahue, III

(57) ABSTRACT

A game ball throwing machine utilizing a rotating arm to pitch a game ball, able to induce a variety of spins and types of pitches interchangeably. The ball thrower includes a base, a support frame attached to the base, rotating arm mechanism attached to the support frame, a source of power rotating the arm, ball holding means attached to the arm, and a human-machine interface which enables control of ball spin, release point, speed and target location. A novel software program integrates the throwing machine, indexing elements and one or more human-machine interface screens, calculating pitch parameters and converting them to machine outputs to enable customization of pitch variety and characteristics to the same or different locations rapidly with a high degree of accuracy, including means to simulate a known pitcher's unique pitch collection.

31 Claims, 22 Drawing Sheets

(56) References Cited

U.S. PATENT DOCUMENTS

| | | | | | |
|---|---|---|---|---|---|
| 3,757,759 | A | | 9/1973 | Haworth | |
| 4,197,827 | A | | 4/1980 | Smith | |
| 4,323,047 | A | | 4/1982 | McIntosh | |
| 4,784,107 | A | * | 11/1988 | Kelly | A63B 69/40 124/48 |
| 4,860,717 | A | * | 8/1989 | Powell | A63B 69/408 124/17 |
| 4,995,371 | A | * | 2/1991 | Kuizinas | A63B 47/002 124/36 |
| 5,121,735 | A | * | 6/1992 | Hancock | A63B 69/408 124/41.1 |
| 5,125,653 | A | | 6/1992 | Kovács | |
| 5,660,386 | A | * | 8/1997 | Krieger | A63B 69/407 124/7 |
| 6,182,648 | B1 | * | 2/2001 | Lundgren | A63B 69/408 124/17 |
| 6,182,649 | B1 | | 2/2001 | Battersby | |
| 6,546,924 | B2 | | 4/2003 | Battersby | |
| 6,820,605 | B1 | * | 11/2004 | Suba | A63B 69/408 124/34 |

* cited by examiner

SPIN INDUCING ARM PITCHING MACHINE

CROSS-REFERENCES TO RELATED APPLICATIONS

This application claims benefit of the following patent application(s) which is/are hereby incorporated by reference: Automatic Ball Pitching Machine, Application No. 62/098,698 filed 31 Dec. 2014

This is a Non-Provisional Utility patent application for the disclosure of a "SPIN INDUCING ARM PITCHING MACHINE."

A portion of the disclosure of this patent document, including the computer program listing, contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

See Specification Appendix for computer listing program as a reduction to practice ascertainable to those skilled in the art The present invention pertains generally to a ball-throwing machine and, more particularly, to a machine that is adapted to use a mechanical arm to pitch baseballs and softballs and throw tennis and other balls interchangeably to the same or different locations and at different speeds and with different amounts and directions of controlled spins. The invention has particular applicability as a baseball pitching machine that is able to interchangeably deliver a variety of pitches at different speeds to the same or to different locations without the need for manually readjusting or repositioning the machine between pitches.

DESCRIPTION OF THE PRIOR ART

Ball-throwing machines are well-known in the art and generally fall into three categories: (1) machines that employ at least one rotating wheel or a pair of rotating, coacting wheels or disks to propel the ball; (2) machines that employ a spring actuated arm mechanism to propel the ball (3); machines that rely on pneumatic pressure to propel the ball.

Over the last 30 years, several "smart" wheeled machines have been introduced, which introduce a ball between the nip of one or more rotating wheels. Examples include U.S. Pat. No. 4,197,827 issued to Tommy L. Smith on Apr. 15, 1980 for Coacting Wheel Ball Projecting Device, and U.S. Pat. No. 4,323,047 which issued on Apr. 6, 1982 to James K. McIntosh et al. for Automatic Ball Pitching Machine and U.S. Pat. No. 5,125,653 which issued to Ferenc Kovacs et al. on Jun. 30, 1992 for Computer Controller Ball-throwing Machine. These machines use electronic controls to adjust the wheel speeds and machine orientation so that the machines can automatically throw a random sequence of pitches without the need for manual adjustments. However, these prior art devices have several shortcomings. First, since there is no wind-up motion, there is not visual cue to the batter that the pitch is imminent. Furthermore, lacking the windup and forward motion of an arm, there is lacking a means for the batter to visually see the ball as it is in the process of being pitched. As a result, these prior art wheeled inventions lack the realistic simulation of a human pitcher to a batter, or of a tennis player serving a ball.

For the purposes of this specification, pitch "location", whether vertical, horizontal, or both, is understood to mean the spatial location of the thrown ball as it reaches the desired distance from the practicing player, in the case of a baseball, cricket or softball batter being understood to mean the desired coordinates of the ball as it crosses the strike zone above home plate in the case of a desired called strike, or outside the strike zone in the case of a desired called ball. In addition, the word "pitch" is understood to mean the propelling of a ball to a user or player, whether that player is a batter or a fielder, and "ball" is understood to mean any object propelled, thrown or caught in a game, including baseballs, softballs, footballs, cricket balls, tennis balls, polo balls and the like.

Another shortcoming to these wheeled machines is their mode of software or firmware (hereinafter collectively called software) control has to this point in time been based on tables of values of spin, aim and velocity to deliver a particular pitch to a given location, such as a standard pre-set curveball to the outside lower corner of home plate in a batter's box. As a result, to set up the machine for the first time in practice, or to vary the type of pitch to the same location still required manual trial-and-error adjustment of the machine by a user, resulting in delays and lack of realism, both detrimental to effective simulation of real-world sport game situations thereby limiting the effectiveness of practicing with these machines.

Another drawback to these prior art methods of programming the machine is it assumes a generic pitch by type, rather than the real-world situation in which all human pitchers have unique nuances, speeds, locations and amounts of spin for a given type of pitch. The related drawback is there is no ability to alter any parameters and have the ball automatically delivered to a desired location on the plate. For example, a specific little league pitcher may throw a 50 MPH fastball that drops eight inches from release to arrival at the front of the plate, with a curve to the right of one inch, while a specific high school pitcher may throw a 70 MPH fastball that drops six inches in the same interval with two inches of curve to the right. The same two pitchers may throw their respective fastballs, and other pitches, differently as a strategy, or due to fatigue as the game continues. These subtle nuances are not simulated by prior art which utilize a set table of variables for each type of pitch. As a result, the prior art did not enable users to quickly and easily program their pitching machines to enable practice against a known pitcher, including one they may face in an upcoming game.

Another large drawback to prior art wheeled pitching machines, is the requirement to speed up or slow down one or more of the drive-wheels to adjust the speed of the pitch. This can be time consuming as well as energy-intensive, for example if reverse voltage or dynamic braking means are used, resulting in heat-buildup.

In an attempt to simulate the throwing motion of a pitcher, arm-style pitching machines were developed. Arm style pitching machines have existed for decades. For example, U.S. Pat. No. 3,757,759 which issued on Sep. 11, 1973 to J. G. Haworth for Automatically Varied Oscillation Type Ball Projecting Device These devices in the prior art generally consist of a short metal arm powered by a mechanical spring. While many players prefer the added realism of arm style machines over the more ubiquitous wheel style machines, these arm machines have had a number of limitations.

Typical types of pitches are known in the art to include fastballs, sinkers, sliders, curveballs, knuckleballs and change-ups, all with a range or variety of speeds and spin rotational directions and amounts. The prior art arm-type devices do not control the spin of the pitched ball as wheeled machines can, so they cannot throw these various types of pitches with various breaks and spins encountered in actual games. Another lack of realism in prior art arm machines is due to their attempts to save energy, reduce spring size and weight and reduce the recoiling action of the rotating arm on the stability and durability of the machine, by making the arm itself in the prior art typically so short, 12-18", it moves so quickly, that the added realism compared to human pitcher is limited. Furthermore, adjusting pitch speeds on prior art arm machines usually involves adjusting one or more heavy, powerful springs, which is physically difficult, time consuming and not easily repeatable.

SUMMARY OF THE INVENTION

Against the foregoing background, it is a primary object of the present invention to provide a ball-throwing machine with an arm that can be used to interchangeably throw a variety of different types of pitches and balls including baseballs, softballs, cricket balls tennis balls and the like with extremely short intervals between different throws.

It is another object of the present invention to provide such a ball-throwing machine that is able to interchangeably deliver a variety of different pitches to a variety of different locations at a variety of different speeds without the need to manually readjust the machine between pitches.

It is yet another object of the present invention to provide such a ball-throwing machine that is able to deliver such pitches with a wide variety of controlled spins without the need for manual adjustment of the machine.

It is another object of the present invention to provide such a ball-throwing machine that allows a user to select the type, speed and location of each pitch or, alternatively, can be programmed to deliver a variety of pitches in a predetermined or random manner, with the interval between different pitches being as short as a few seconds.

It is still yet another object of the present invention to provide such a ball-throwing machine in which the controls for such machine can be easily reprogrammed to simulate a pre-determined or random pitch pattern. It is another object of the present invention to provide an articulated arm style ball throwing machine software and hardware system that can take a multitude of inputs including pitch location, speed and amount and direction of spin and break, calculate all the physical parameters through arithmetic formulae and automatically adjust the arm speed, angle to the user, release point and spin mechanism to produce the pitch exactly input with no trial-and-error guesswork by the user.

It is still another object of the present invention to provide such an arm-style ball throwing machine with a longer, more realistic mechanical arm motion better simulating a human pitcher, and with the ability to throw overhand and underhand pitches with spin and break, with improved energy efficiency means for recharging spring-driven embodiments.

Against the above background, it is the primary object of the present invention to provide a novel arm-style ball throwing machine with the nonobvious means and unanticipated benefits to throw or pitch balls with controlled amounts and direction of spin, both to the same and to different locations with no guesswork by the user, something never before achieved by prior art arm-type machines nor by wheel-type machines.

Disclosed are various embodiments of this invention, including various degrees of automation, features and powering means, ranging from fully software-automated machine capable of delivering a random sequence of pitches including curves in any direction, an automated motorized machine capable of throwing primarily fastballs various speeds, and a manual machine powered by the operator, with a novel energy efficient enhancement, that throws fastballs with spin. While the manual machine has limited capability compared to the others, it is lower cost to build, more portable, and only requires a human power source.

The multiple embodiments defined by the specification and claims of this invention are all inter-related in that each has a source of power driving the rotating throwing arm, each involves a rotating forward motion of an arm component to pitch the ball, each has a ball holder means at the end of the arm and each has a means for a human user to interface with the machine in some manner.

While automated machines covered by this invention have greater capabilities and are easier to use, the manual machines are simpler, cheaper, lighter, and more portable (only human power required).

This invention enhances the realism of prior art arm machines by lengthening the arm, controlling the ball spin, and adding the ability to throw a random sequence of pitches by automating adjustment of pitch release point and pitch speed and spin intensity and direction as well as pitch location vertically and horizontally through algorithmically calculated means by the inventive software means.

The machine preferred embodiment, consists of the following elements: a base structure, a rotating arm with or without joints to simulate the human body, a gripper or ball holder at the end of the arm capable of imparting a controlled spin (both direction and amount) on a ball as it is thrown, a mechanical power means to drive the arm at varying speeds, a method to adjust pitch location both horizontally and vertically, a control system to coordinate the drive unit, arm, and ball holder to deliver a variety of pitches in a variety of locations either individually or in a sequence and preferably a user interface to allow an operator to program, select, or otherwise control the machine.

Each of these elements may accomplished in a variety of ways, as disclosed herein, or simply removed for cost savings, and remain within the scope and intent of the subject invention, in that all involve an arm-style pitching machine with means to adjust the path of the pitched ball not only by changing the horizontal and vertical path of the pitching arm, but by also adjusting the release point and the amount and direction of spin on the ball. The permutations are best addressed by discussing each element separately.

The base structure is the simplest element of the design but may take any variety of shapes. It may have a combination of wheels, feet, or mounting studs to fix the machine to the ground or floor while allowing easy transport. Unless the frame is attached to the ground or floor in some manner, the bottom of the frame should include a high friction, resilient material to absorb recoil from thrown pitches and prevent the machine from moving. The frame preferably includes barriers or guards to prevent accidental contact with the moving arm while still providing a clear view of the arm to the batter.

The rotating arm propels the ball while providing a realistic visual for the batter. One embodiment is adding an elbow joint, which can both reduce the moment of inertia of the assembly and increases the realism of the delivery motion. Lowering the rotational inertia of the system allows use of longer, more realistic arm sections compared to existing machines and/or reduces the power requirements of the machine.

The slower moving lower section provides a visual cue for the hitter, who may have difficulty seeing the faster moving top section. Adding additional joints to simulate the shoulder or hip joints is possible, adding further realism. Removing the elbow joint simplifies the machine, but reduces realism, except when used in an underhand pitching configuration, such as for fast-pitch softball, when pitchers substantially pitch with a straight arm.

For a realistic delivery, the top (forearm) section of the arm must rotate at a faster rate than the lower section. This can be accomplished by a four bar mechanism, chains and sprockets, timing belts, wire rope, pulleys or any number of similar standard mechanical components, as shown in later figures herein.

The ball holder or gripper means can take many forms, depending on the level of functionality desired. Multiple embodiments disclosed include: 1) basic passive ball holder 2) active two sided grip 3) passive one sided grip. The basic holder has limited functionality but is simpler and lower cost to produce and lighter in weight, reducing the energy required to throw a ball. In this specification, 'active' and 'passive' describe whether the ball is released from the grip by its own inertia as the arm decelerates, or by an active mechanism contained in the ball holder or adjacent to it.

The basic ball holder keeps the ball in place using gravity when the arm is at rest and centrifugal force when the arm is moving. The shape of the holder provides a stable location for the ball to rest until it is released. As the arm decelerates at the end of its throwing motion, the ball is forced from the holder by its own inertia. As the ball exits, the holder's "fingers" overhang the path of the ball, causing it to roll against them, imparting spin. The spin can be increased by covering the fingers with a high friction or resilient material.

The benefit of realistic arm motion can be applied to arm machines whose arm axis is at any angle, but the most common are the overhand baseball and underhand softball motions, both accomplished by rotating the arm on a horizontal shaft.

Softball pitchers often use a longer arm motion than baseball pitchers, rotating their arm underhand more than 360° during acceleration. To best approximate this delivery with a machine which is limited to 180° of powered rotation, the arm and gripper are relocated to a second shaft. The first shaft is powered as described herein. The second shaft is connected to the first by any number of mechanical linkages, such as belts and pulleys, chain and sprocket, or gears, such that the second shaft rotates twice for every rotation of the first. This converts the 180° power stroke of the first shaft into a 360° arm motion of the second.

For embodiments where the arm doesn't rotate a full 360 degree arc, or where ball is loaded while the hook is facing downward, a resilient "thumb" or spring loaded roller can be added to hold ball in place until arm starts moving and centrifugal force takes over. This is discussed further in the drawing description.

The active two sided grip squeezes the ball between two low friction ball bearings during the throwing motion, then releases the ball at the appropriate time as determined by the programmed control system. The gripping force may be provided by electromagnets, solenoids, pneumatics, cables, or any number of mechanisms. The gripper holds the ball firmly during the pitch and releases it quickly, so as not to not interfere with the ball's rotation. The gripper may separate from spring energy, inertia, or reversing the squeezing mechanism. During the throwing motion, the ball spins on an axis defined by the gripper's bearings. The bearings can be mounted on a pivoting mechanism to adjust the direction of the spin, and thus the direction of curve. This allows ball spin in any direction, whereas a fixed gripper can only control spin in a vertical plane.

The ball rotation may be powered by a variable speed motor built into the gripper, or the ball may be spun before the pitch is thrown, in which case the gripper's low friction bearings would allow the ball to continue to spin after the power is removed. Spinning the ball before launch removes the weight of the spinning motor from the arm assembly. The axis of rotation can be adjusted by any number of means, such as a step motor built into the gripper. Varying the orientation of the axis of rotation provides the ability to control which direction the ball spins, and therefore curves.

The passive one sided gripper may take the form of a conical or cylindrical cup or multiple fingers which center the ball to minimize centrifugal forces when the ball is spun. The ball is held in the cup by friction, spring loaded balls or protrusions of a resilient material. The cup is mounted on a pin joint or hinge that allows the cup to rotate forward in the direction of the pitch, but not backward. With this arrangement, the ball is held securely in the cup as the arm accelerates forward, but is released when the arm decelerates and the cup rotates forward. The cup is held in its rearward position by a low power spring or magnet to compensate for forces generated by an unbalanced spinning ball. This cup retaining force must be less than the deceleration force at the machine's slowest setting.

It should be noted that even with a fixed horizontal axis of ball rotation, this machine provides a vast improvement over existing arm machines. In this simplified configuration, the machine can still throw both overhand fastballs with variable backspin and overhand curves with variable topspin, something no other arm machine can presently do. In this embodiment, there is no need to account for horizontal pitch location adjustments as all pitches only curve vertically.

Traditional prior art arm style machines use mechanical springs to power the arm. Using a spring to store energy allows a lower rate of energy input than a direct drive system. A smart machine requires a spring that can change its rate quickly so it can throw pitches at different speeds. While this could be accomplished by moving the "fixed" end of the spring (the end not connected to the moving arm), the preferred embodiment instead uses an air spring or cylinder because it is easier to quickly adjust the spring rate by varying the air pressure applied to the piston. Air springs are also easy to de-power by draining all compressed air from the system by simply opening a valve. This makes the air spring machine much safer to move and repair. Prior art equipped with mechanical springs have proven dangerous in these situations, causing numerous serious injuries.

For manual human-powered machines, it is important to efficiently convert the user's physical effort into pitch velocity. A good way to do this is to utilize the entire body weight of the user by way of a platform, step or pedal. The work applied to the step can pressurize a pneumatic system or be stored in a mechanical spring.

The human-powered system variation disclosed herein can uniquely be made nearly twice as efficient by precharging the compressed air or spring. The energy stored in a spring is equal to the force applied integrated over the distance traveled. With a free spring, the starting force is zero, and the energy stored=½*Fx where F is the maximum force, and x is the distance traveled. The maximum force that can easily be applied is the weight of the user, so the maximum possible energy stored in a free spring is E=½Wx. However, with a pre-loaded spring, the initial force is greater than zero and more energy is stored for a given deflection. The theoretical limit would be a preload just under the user's weight, resulting in a near constant force throughout the travel, or E=Wx. This is twice the potential energy available from a free spring. The same concepts apply for a compressed air system, where a large reservoir can provide a near constant force throughout the step's travel.

The air cylinder and crank mechanism is laid out in a fashion unlike any other prior pitching machine. The cylinder does not bottom out at either end of its stroke, allowing free rotation of the arm and preventing damage to the cylinder. At top dead center, the start point of the throwing motion, the mechanism is self locking. This allows the valves to open and fully pressurize the system before any motion occurs, minimizing flow losses. A second air cylinder forces the crank off top dead center, freeing the main cylinder to rotate the arm quickly.

At bottom dead center, the pressurized air cylinder becomes a brake for the arm. With the use of one-way bearings in the crank system, the arm stops once its inertia is overcome by the braking force, and it does not oscillate, as it would without the one-way bearings. The main cylinder is then retracted to top dead center position for another pitch. The combination of gravity and inertia keep the arm from self locking at the bottom dead center position.

By varying the pressure applied to the main cylinder, the speed of the arm is controlled. Proper sizing of valves and air lines is necessary to ensure a rapid throwing motion. A compressed air reservoir placed near the air cylinder aids in supplying the required flow.

All embodiments include a method to adjust pitch location. There are many ways to adjust the aim of the machine, including moving the base structure, moving the arm mechanism relative to the structure, and, unlike prior art, changing the release point of the ball. Methods may be manual or automated depending on the particular embodiment, but while numerous methods have been established in prior art of both pitching machines and mechanisms in general, such as gear trains, stepper motors, linear actuators, sprockets, belts, etc, none have been effective on arm-type machines. One means disclosed herein for vertical adjustment is via threaded rod, either manually or automatically, where the cylinder and crank assembly rotates on the same axis as the arm. Rotating this assembly moves the release point and release angle, thus changing the vertical location of the pitch. Unlike prior art, the ball may conversely be released by the gripper means, upon signal from the microprocessor at a calculated point in the arm motion to achieve vertical control of the pitch.

The preferred user interface, coupled with the unique software means included in this invention, can be mounted on the back of the machine, or preferably contained within a smartphone, tablet or other portable wireless device separate from but in communication with the motive devices on the machine. The user can set pitch speed, spin angle, and spin amount directly. These values are converted to 1) pressure in air cylinder, which correlates to speed; 2) ball gripper RPM=spin amount; and 3) ball gripper angle=spin direction. One can determine the pressure/speed correlation empirically by graphing the results at a wide range of pressures, then calculate a best-fit equation. Spin amount and spin direction are set directly in this embodiment. Aiming to achieve the desired pitch location is done via the novel mathematical formula software means and process disclosed and claimed herein.

Low cost, commercially available microcontrollers and microprocessors are used to control the machine. The specific hardware used is not critical, but some possible selections are the Raspberry Pi, Beaglebone Black, or any similar device which supports web hosting or wireless communication either natively or with additional hardware, and provides GPIO (General Purpose Input/Output). Control signals and sensors interface to and control and sense the real-world the hardware in a traditional manner. What is novel, is the unique algorithm means within the system software which calculates appropriate arm speeds and gripper/spinner parameters and integrates the signals, sensors and hardware together with a unique and novel interface device and collection of screens, each with features and benefits not previously anticipated by those skilled in the art of pitching machines.

The user interface is accomplished via a standard wireless touchscreen device, such as a tablet or smartphone, running a standard web browser, coupled with the novel software system of the subject invention. The invention can used with a web browser, or custom written application. The Program may be run on any wireless device and/or host device (Raspberry Pi, etc.) One can use VNC (virtual network communication) protocol to connect the wireless device to the host device.

The machine's control system includes a web server and wireless interface. The user loads the web pages hosted by the web server and controls the machine by manipulating the inputs shown on the interactive web pages. Through use of the unique software, it is also possible to create custom applications based on the touchscreen's operating system, for download from the internet.

The software and hardware configuration of the subject invention provides users a novel user-friendly, direct method for specifying pitch parameters on any type of machine. These input parameters can easily be used to calculate the individual gripper angle, ball spin rate and/or arm speeds and release point required to generate the selected pitch.

Because the user may not be familiar with amount of spin used with typical pitches, (RPM of an average curveball, for example), it is convenient to select a maximum reasonable spin amount, say 3600 RPM, and let the user select a percentage of that maximum amount.

For arithmetic calculations, a frame of reference or coordinate system must be defined for spin direction. It is convenient to select the vertical direction to be 0 degrees, with angles increasing in a clockwise direction, as seen by the machine operator.

While the software means can be specifically for an arm-type machine, it can also be used on a wheel-type machine. On a multiple gripper wheel machine with inputs:

PS=pitch speed

ANG1=direction of spin measured as an angle

SPNPCT=amount of spin, a percentage of the maximum tangential gripper wheel speed MAXSPIN=maximum tangential gripper wheel speed for each wheel positioned at an angle ANG2, tangential wheel speed WS may be calculated as $$WS=PS-SPNPCT*\cos(ANG2-ANG1)*MAXSPIN.$$

A computer program written in C for a 3 wheel machine was included in a separate attachment to the provisional application incorporated herein by reference, and also a part of the file wrapper for this non-provisional application as an appendix. This program takes digital inputs from the user interface and controls the multiple LEDs on the interface screen to create a display indicating pitch speed, spin direction, and spin amount. The program also writes values digital potentiometers to control the ball-spinner speeds, and can similarly provide values for a digital pressure supply or electric motor to adjust arm velocity, and gripper release timer or positional sensor for pitch release point.

Other machines have used tables of values obtained by trial and error to aim their machines. These values are programmed by either the manufacturer or the user, but always by trial and error. This limits the available number of pitches. The inventive system disclosed herein is different. The achieved goal by this invention, lacking in the prior art, is to modify the aim of the machine automatically so that no matter how the pitch is changed by the user (speed, curve direction, or curve amount), the ball ends up in the same place when it crosses the plate, if desired. Whenever a pitch is changed, 1) the pitch trajectory is calculated, giving data for the theoretical impact point, X and Y, 2) the impact point is compared to the impact point of the previous pitch, X and Y and 3) the machine's aim is adjusted by the difference, so that each pitch will impact the same point. Impact point may be adjusted manually, but it will affect all pitches. Impact point, or aimpoint, is the horizontal and vertical location of a pitch as it crosses the plate. The following includes all variables used, their definition, units, and how they were derived—hard numbers defined by the hardware, user inputs, and calculated values. The variables and formulae disclosed herein all are resident within the unique nonobvious software program used in the subject invention, and are herein referred to as arithmetic formulae and mathematical calculation for simplicity, and serve as full disclosure of the claimed software. Further explanation is in the listing below showing automatic and manual calculation means. Automatic:

| VARIABLE | DESCRIPTION | UNITS | ORIGIN | EXAMPLE |
|---|---|---|---|---|
| maxspin | max ball spin RPM | RPM | constant | 3600 |
| stepsize | step angle per pulse | degrees | constant | 0.0383 |
| pitchspeed | pitch speed | mph | user input | 72 |
| z | distance to plate | ft | user input | 55 |
| spinangle | ball spin angle | degrees | user input | 90 |
| spinamountPCT | % of max spin | % | user input | 50 |
| CLift | coeff. of lift | *1 | user input | 0.00001 |
| spinamountRPM | ball spin amount | RPM | calculated | 1800 |
| acc-x | horizontal acceleration | in/s^2 | calculated | 93.31 |
| acc-y | vertical acceleration | in/s^2 | calculated | −386.40 |
| t | time in flight | s | calculated | 0.52 |
| x | horizontal distance | inches | calculated | 12.66 |
| y | vertical distance | inches | calculated | −52.41 |
| ang-x | horizontal angle | degrees | calculated | 1.10 |
| ang-y | vertical angle | degrees | calculated | −4.54 |
| xstep | hor steps | steps | calculated | −29 |
| ystep | ver steps | steps | calculated | 119 |

*1 = in/(s^2 * RPM * mph^2)

spinamountRPM=(spinamountPCT/100)*maxspin acc-$x$=sin(spinangle)
*spinamountRPM*$C$Lift*pitchspeed^2 acc-$y$=cos(spinangle)
*spinamountRPM*$C$Lift*pitchspeed^2

$t$=$z$/(1.4667*$v$)

$x$=0.5*acc-$x$*$t$^2

$y$=0.5*acc-$y$*$t$^2 ang-$x$=arctan($x$/($z$*12))

ang-$y$=arctan($y$/($z$*12))

$x$step=−int(ang-$x$/stepsize+0.5)

$y$step=−int(ang-$y$/stepsize+0.5)

*1=in/($s$^2*RPM*mph^2) Equations spinamountRPM=(spinamountPCT/100)*maxspin acc-$x$=sin(spinangle)
*spinamountRPM*$C$Lift*pitchspeed^2 acc-$y$=cos(spinangle)
*spinamountRPM*$C$Lift*pitchspeed^2

$t$=$z$/(1.4667*$v$)

$x$=0.5*acc-$x$*$t$^2

$y$=0.5*acc-$y$*$t$^2 ang-$x$=arctan($x$/($z$*12))

ang-$y$=arctan($y$/($z$*12))

$x$step=−int(ang-$x$/stepsize+0.5)

$y$step=−int(ang-$y$/stepsize+0.5) Equations

HMI Manual Entry Aiming Calculations

| VARIABLE | DESCRIPTION | UNITS | ORIGIN | EXAMPLE |
|---|---|---|---|---|
| xslide | horizontal distance | inches | user input | 6 |
| yslide | vertical distance | inches | user input | 12 |
| ang-xm | horizontal angle | degrees | calculated | 0.52 |
| ang-ym | vertical angle | degrees | calculated | 1.04 |
| xstepm | hor steps (manual) | steps | calculated | 14 |
| ystepm | ver steps (manual) | steps | calculated | 27 |

ang-$xm$=arctan($x$slide/($z$*12))

ang-$ym$=arctan($y$slide/($z$*12))

$x$step$m$=−int(ang-$xm$/stepsize+0.5)

$y$step$m$=−int(ang-$ym$/stepsize+0.5) Equations:

maxspin—The maximum rotating means speed used to spin the ball, measured in RPM. Ball spin is created by spinning the throwing arm wheel/cylinder/cups, or the prelaunch wheel at different speeds.

In several embodiments it is an arbitrary value used to ease pitch specification by allowing users to specify spin by percentage instead of RPM.

stepsize—the step angle of the aiming stepper motor, including any gears pitchspeed—pitch speed z—distance from machine to plate spinangle—direction of ball spin to a given reference point. For example 0 could be straight up and positive direction is clockwise from the pitcher's viewpoint spinamountPCT—amount of ball spin as a percentage of maxspin CLift—coefficient of lift, a value used to calculate the ball's acceleration perpendicular to its travel from spinning, based on ball spin and velocity. Can be user adjusted to account for air density and ball condition.

spinamountRPM—calculated value of ball spin in RPM acc-x—horizontal acceleration acc-y—vertical acceleration, includes gravity t—calculated time in flight x—calculated distance ball moves horizontally during flight y—calculated distance ball moves vertically during flight ang-x—angle ball moves horizontally during flight ang-y—angle ball moves vertically during flight xstep—number of stepper motor steps to sweep ang-x ystep—number of stepper motor steps to sweep ang-y xslide—horizontal distance adjustment measured at impact point yslide—vertical distance adjustment measured at impact point ang-xm—angle adjustment to cause xslide distance adjustment ang-ym—angle adjustment to cause yslide distance adjustment xstepm—number of stepper motor steps to sweep ang-xm ystepm—number of stepper motor steps to sweep ang-ym Any of several traditional ball storage methods may be used with this invention, including a rotating drum, linear storage in a pipe, or Spinball Sports LLC's multi-cylinder turret.

The benefit of added realism applies to both overhand and underhand models, and also other arm angles. It is common for softball pitchers to use a 360° delivery motion. Since the piston/crank design shown in FIG. 4 is limited to 180° of powered travel, softball models require a mechanical system, such as gears, pulleys, sprockets, to convert the range of travel between the cylinder and the arm.

Existing spring powered arm machines require the user to perform two separate acts to throw a ball: charging the spring, then releasing a latch. However, the benefit of not needing a separate release mechanism is still realized in the inventions 360° arm travel embodiment.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION

All the following descriptions and embodiments relate to the same invention, an arm-type pitching machine which can control the spin, velocity and location of a pitched ball, to the degree and by means the prior art has not achieved nor anticipated. For simplicity, in this specification and claims the words pitch, pitcher and pitching is understood to mean not only pitching a ball to a batter, but also throwing a ball in various ways to a fielder, tennis player and other persons desiring to practice any game, sport or activity involving any object which may be propelled by the subject machine and process.

Figure 1:
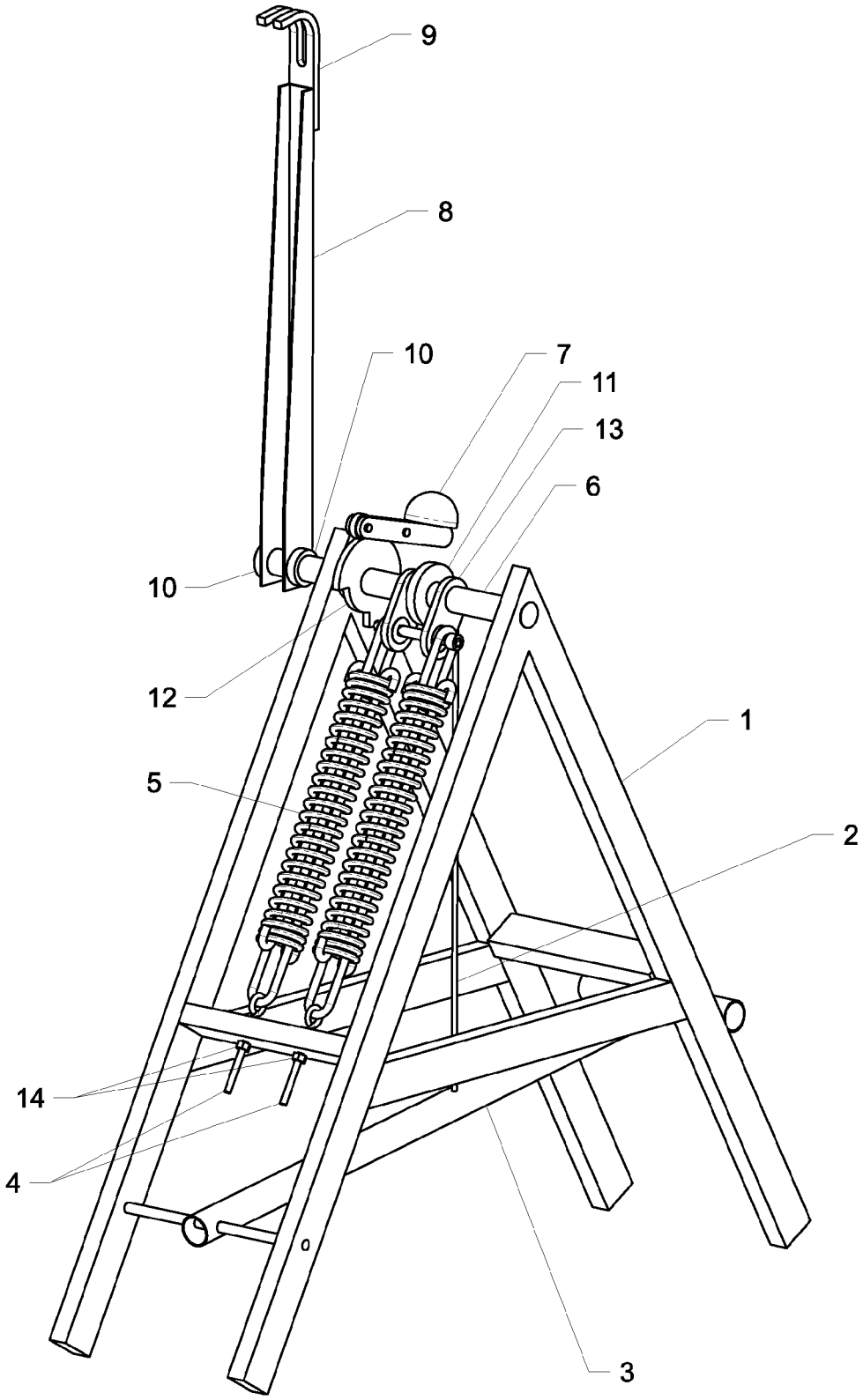
FIG. 1: Perspective view of the present invention embodiment of the foot pedal powered machine with mechanical springs and reciprocating arm.

Turning to FIG. 1, indicating a foot-powered version of the machine, including a basic frame 1, to which is incorporated a cable 2 connected to a foot pedal 3. Connected to the frame are one or more threaded fasteners, such as eyebolts 4, which serve to secure one or more springs 5 which provide the twisting power or torque upon a rotating shaft 6. This twisting power is released by the user upon depression of a latch release 7, rotating shaft 6 and arm 8 and causing ball gripper 9 to rotate in a forward motion propelling the ball to the target. Ball gripper 9 is shaped to some degree in a curve with a means to grip the ball such as appendages hereafter referred to as fingers. Gripper 9 is attached to moving arm 8, which is connected to rotating shaft 6 via clamping shaft collars 10. When operator steps down on foot pedal 3, cable 2 is pulled down, rotating pulley 11, which rotates shaft 6. When shaft has rotated far enough, cam latch 7 engages notched disk 12, locking arm 8 from rotating forward. Springs 5 provide torque on rotating shaft 6 through crank arms 13. Operator or feeder means, not shown, then loads ball into gripper 9. When cam latch 7 is released, arm 8 swings forward, propelling the ball. Ball is released when mechanism reaches the position shown in FIG. 1, where springs 5, crank arms 13, and rotating shaft 6 are all aligned, and springs 5 begin to decelerate arm 8.

Pitch velocity is controlled by adjusting tension in springs 5. Tension is adjusted by moving the eyebolts 4 closer or farther from the rotating shaft 6. Eyebolts 4 are moved by rotating the threaded nuts 14. These nuts 14 can be replaced with threaded knobs to eliminate the need for tools, and in other variations of the invention, replaced with a powered screw drive, servo motor or other powered means to move the eyebolts 4. Pulley 11 is spring loaded such that it engages with cable 2 only when foot pedal 3 is pressed down. This prevents pulley 11 from interfering with the rotation of shaft 6 and arm 8 during the throwing motion, after foot pedal 3 has been released.

Ball release angle and trajectory can be set by changing the angle of arm 8 relative to shaft 6 by loosening clamping shaft collars 10, moving the arm, and re-tightening the collars. Aim can also be adjusted by changing the angle of the entire throwing assembly, 4-14, relative to frame 1.

Cam latch 7 is clearly visible to hitter to aid with timing. Drawbar type tension springs provide greater safety than tension springs in case of spring failure. In another embodiment, the mechanical springs are replaced with air cylinder (s). Tension is then adjusted by changing the air pressure in the cylinder. Cam latch 7 may include a low friction ball bearing to ease latch release. Frame 1 may be modified to include hinges so that it can fold up like a ladder for easier storage and transport. With these hinges added, the pitch release angle can be adjusted by changing the angle between the legs of the frame—the greater the angle between them, the higher the release angle.

Figure 2:
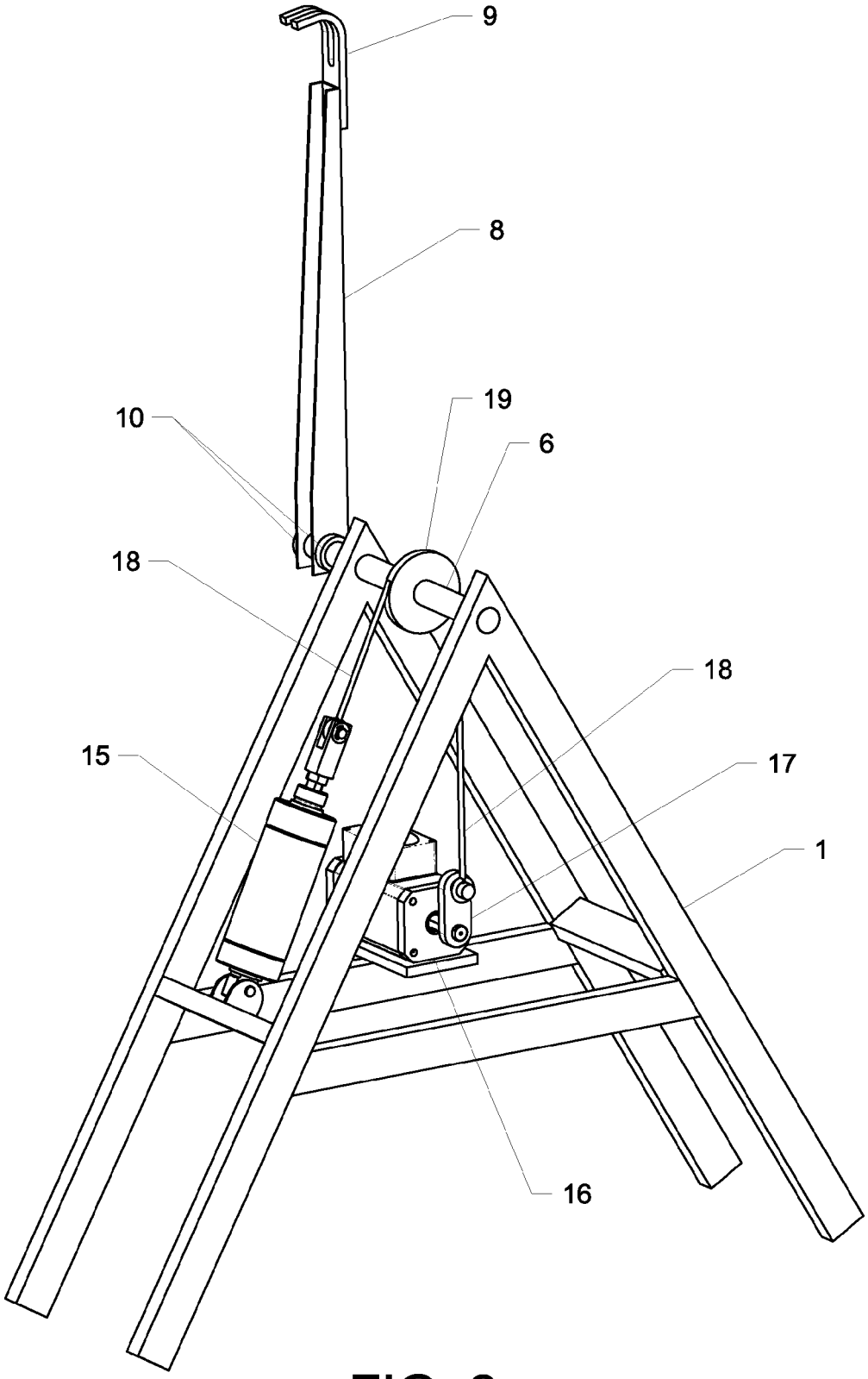
FIG. 2: Perspective view of the present invention embodiment air spring machine with reciprocating arm, powered by electric motor.

FIG. 2 discloses a similar embodiment shown in FIG. 1, with the following differences: mechanical springs are replaced by an air cylinder 15, which may be attached to a reservoir or accumulator, not shown. Machine is powered by an electric gearmotor 16, which rotates the crank arm 17. Crank arm 17 is coupled to gearmotor 16 with a one way bearing. Air cylinder 15 is pressurized at rod end, causing the cylinder to act as a tension spring. Spring rate is adjusted by changing the pressure provided to the cylinder, which can be done quite rapidly with either a digital pressure controller and/or a quick pressure release/supply valve to quickly lower or increase the pressure in the air cylinder 15.

As gear motor 16 rotates crank 17, roller chain 18 is pulled down, rotating sprocket 19, which rotates shaft 6, arm 8, and ball gripper 9. When crank arm 17 reaches 6:00 position, tension in the roller chain causes the crank arm 17 to suddenly rotate freely to the 12:00 position, quickly accelerating arm 8, throwing the ball.

Figure 3:
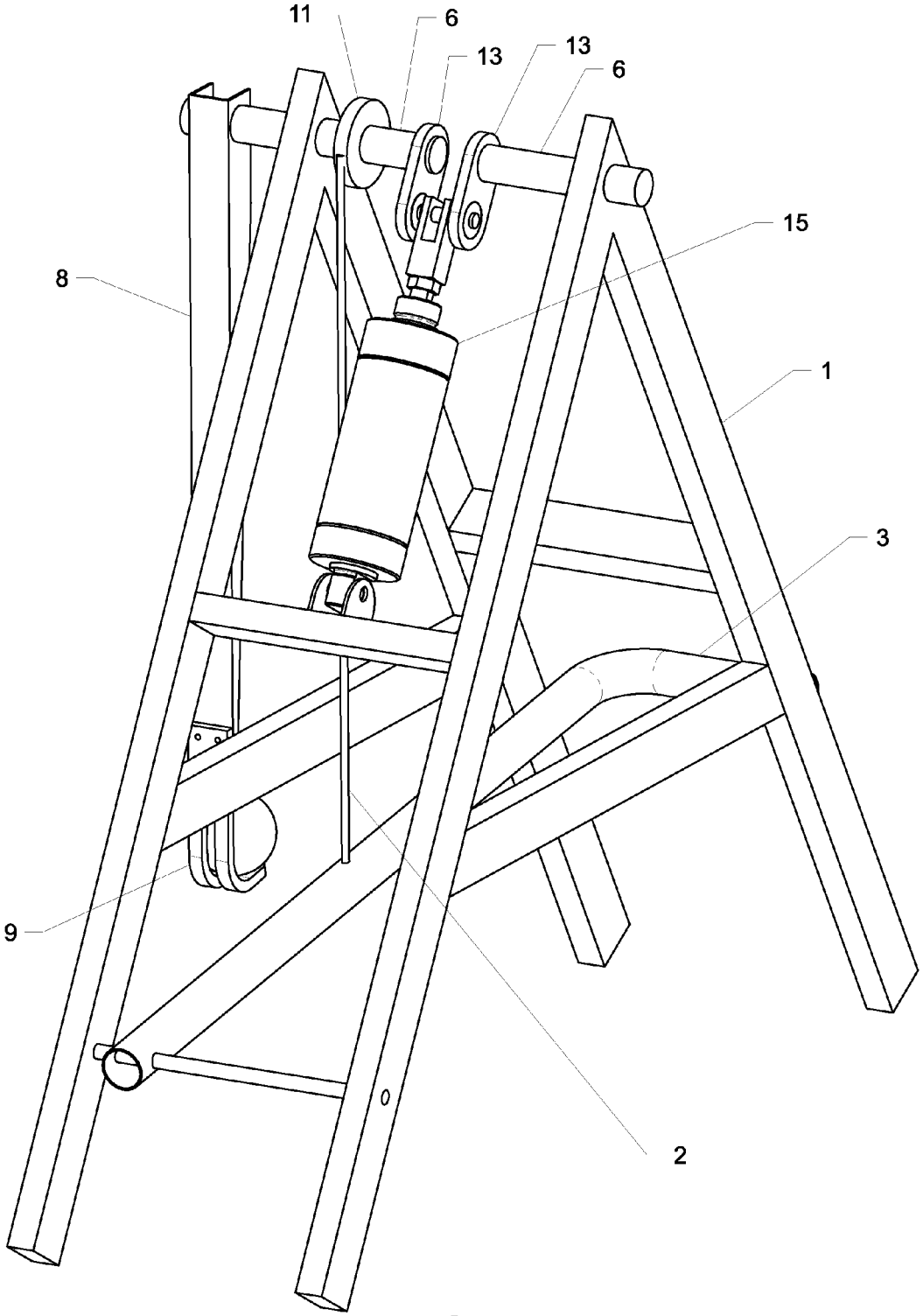
FIG. 3: Perspective view of the present invention embodiment foot powered machine with air spring and 360 degree arm sweep.

FIG. 3 discloses a basic foot powered variation with an air spring and 360 degree arm sweep. This embodiment differs from previously discussed in that: arm 8 and gripper 9 rotate a complete 360 degrees each pitch, rather than reciprocating back and forth. Shaft 6 is split into two fully supported shafts so that the rod of air cylinder 15 can pass between them. This results in a single cylinder piston engine layout. In embodiment shown, air cylinder 15 is used as a compression spring, whereas previously it had been used in tension.

Shafts 6 are fitted with one-way bearings so that arm 8 may only rotate in the pitching direction. As foot pedal 3 is depressed, cable 2 pulls down on pulley 11, rotating shaft 6 and compressing air cylinder 15. As mechanism passes the fully compressed position shown in FIG. 3, the cylinder reverses torque on the shafts 6, causing them to rotate quickly 180 degrees, throwing the ball. At the cylinder's fully extended position, it becomes a brake, slowing the arm's rotation as it absorbs the arm's momentum.

The energy absorbed by the cylinder 15 reduces the amount of energy required to be added to the system for the next pitch. For example, if the arm rotates from 0-180 degrees during cylinder expansion, it may travel from 180-270 degrees during deceleration. That only leaves 270-360 degrees of travel powered by user input.

Pulley 11 includes a one way bearing so that the shaft 6 may freely rotate ahead of the pulley. Foot pedal 3 is lightly spring loaded to return to original position when user removes their weight.

Figure 4:
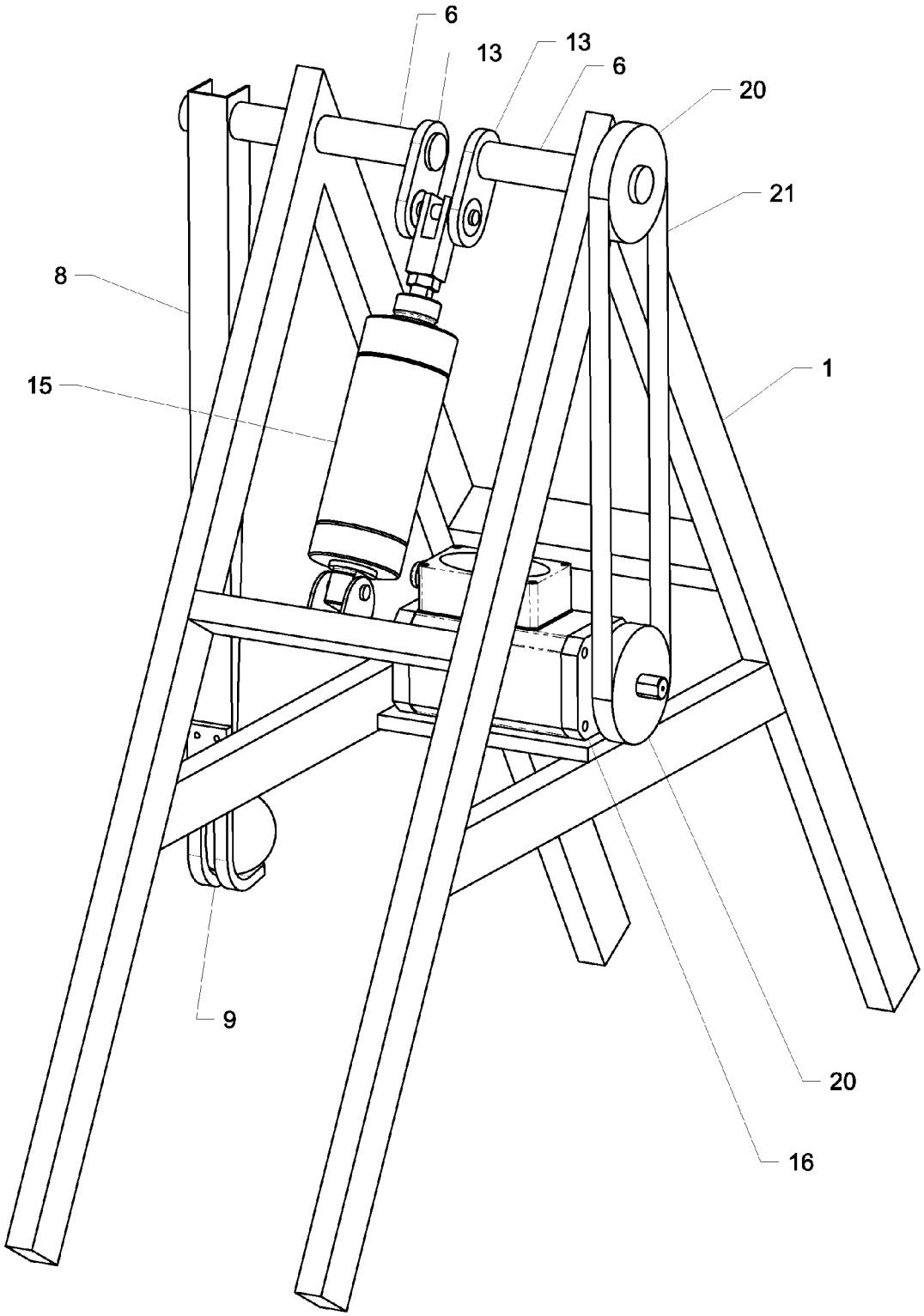
FIG. 4: Perspective view of the present invention embodiment electric motor powered machine with air spring and 360 arm sweep.

FIG. 4 indicates the basic electric motor powered machine with air spring and 360 arm sweep. This embodiment replaces the foot pedal 3 and one way pulley 11, with an electric gearmotor 16 and one way timing belt pulleys 20. As gearmotor 16 rotates, belt 21 conveys the torque to rotating shaft 6.

Figure 5:
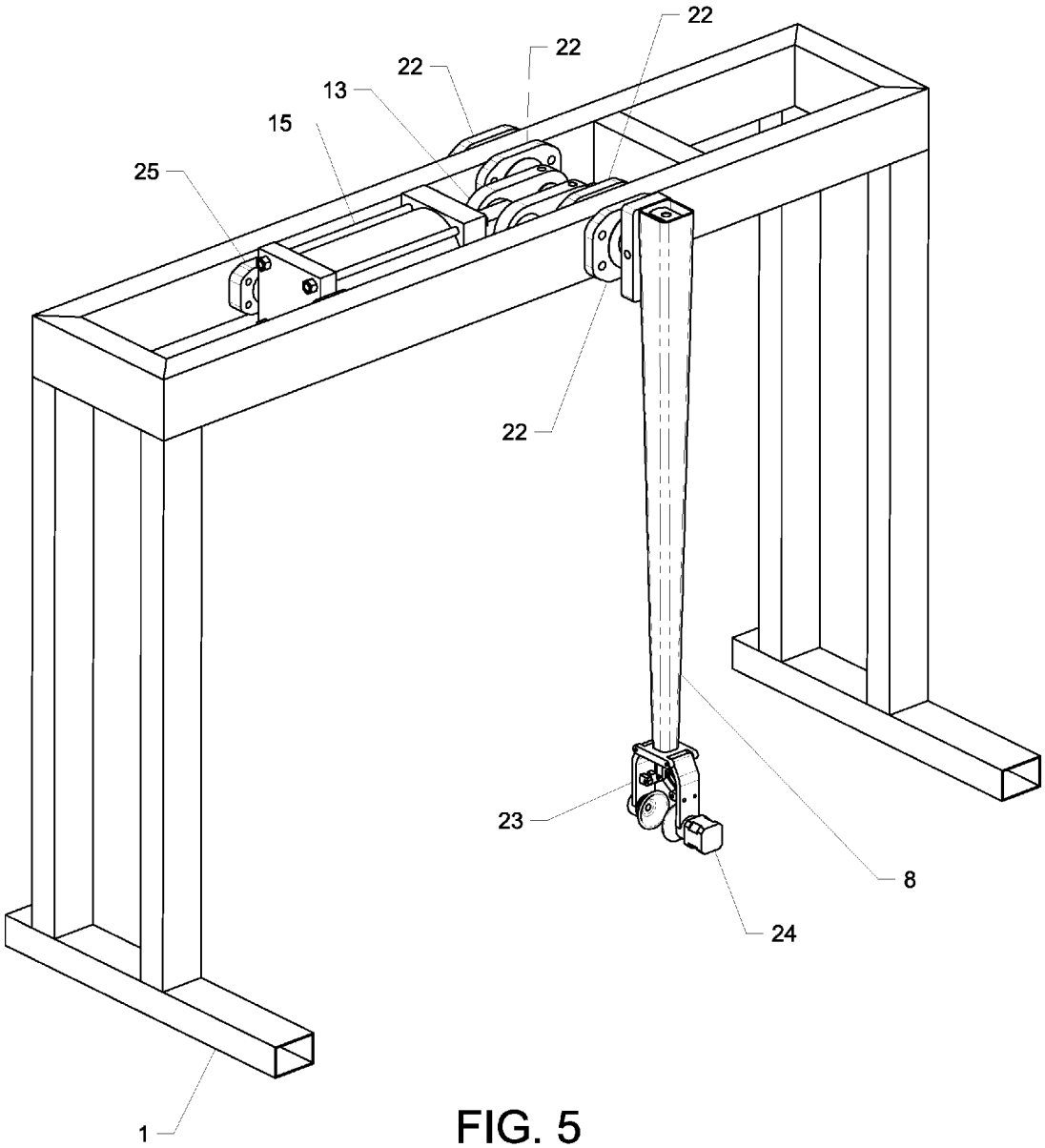
FIG. 5: Perspective view of the present invention illustrating pneumatic machine with spinning gripper.

Turning to FIG. 5, this embodiment allows for automatically adjusting the pitch in the vertical plane: velocity, spin/curve, and launch angle. Air cylinder 15 is again set in a single cylinder piston engine layout, and one way bearings 22 cause the arm to only rotate forward. Pitch speed is adjusted by varying the pressure in the cylinder. Ball spin is controlled in the gripper 23 by a small variable speed, reversible motor 24 attached to the ball gripper 23. Release angle is controlled by timing the release of the gripper 23. Air cylinder 15 pivots on housed low friction bearings 25 as arm rotates.

There are various ways to control and power the same mechanism. First, the main cylinder 15 may be powered in both directions. This can cause issues at top dead center and bottom dead center, where the mechanism is self-locking. At bottom dead center, both the arm's momentum from releasing the last pitch plus the weight of the cylinder 15 itself will cause the mechanism to pass through this self-locking position. At top dead center, the self-locking can be an advantage. It allows the cylinder to pause and fully pressurize, eliminating losses from air flow through valves and supply lines. However it does require the addition of another powered element like a second air cylinder 15 or solenoid to bump the air cylinder 15 past top dead center and into its powered rotation.

The cylinder 15 could also be used as variable air spring, with the entire mechanism powered by an electric gear motor 16 as in previous embodiments. In that case, the pressure must be varied between pitches. This can be accomplished by active means with air compressors, reservoirs and valves, but it can also be accomplished by effectively changing the size of the reservoir. This is accomplished by connecting multiple reservoirs and opening and closing valves as needed to provide a multitude of reservoir sizes. The smaller the reservoir, the higher the pressure generated as the air cylinder is compressed.

The reservoirs can be sized such that each one halves the additional velocity imparted on the ball from the previous one, in effect creating a binary system to minimize the number of reservoirs and valves required to create a high number of pitch speeds. For example, if the speed range is to be 50-95 mph, four reservoirs can be opened or closed to create 16 different combinations, creating 16 different, equally spaced speeds. For a speed range of 50-95 mph, this is a step of just 3 mph.

Figure 6:
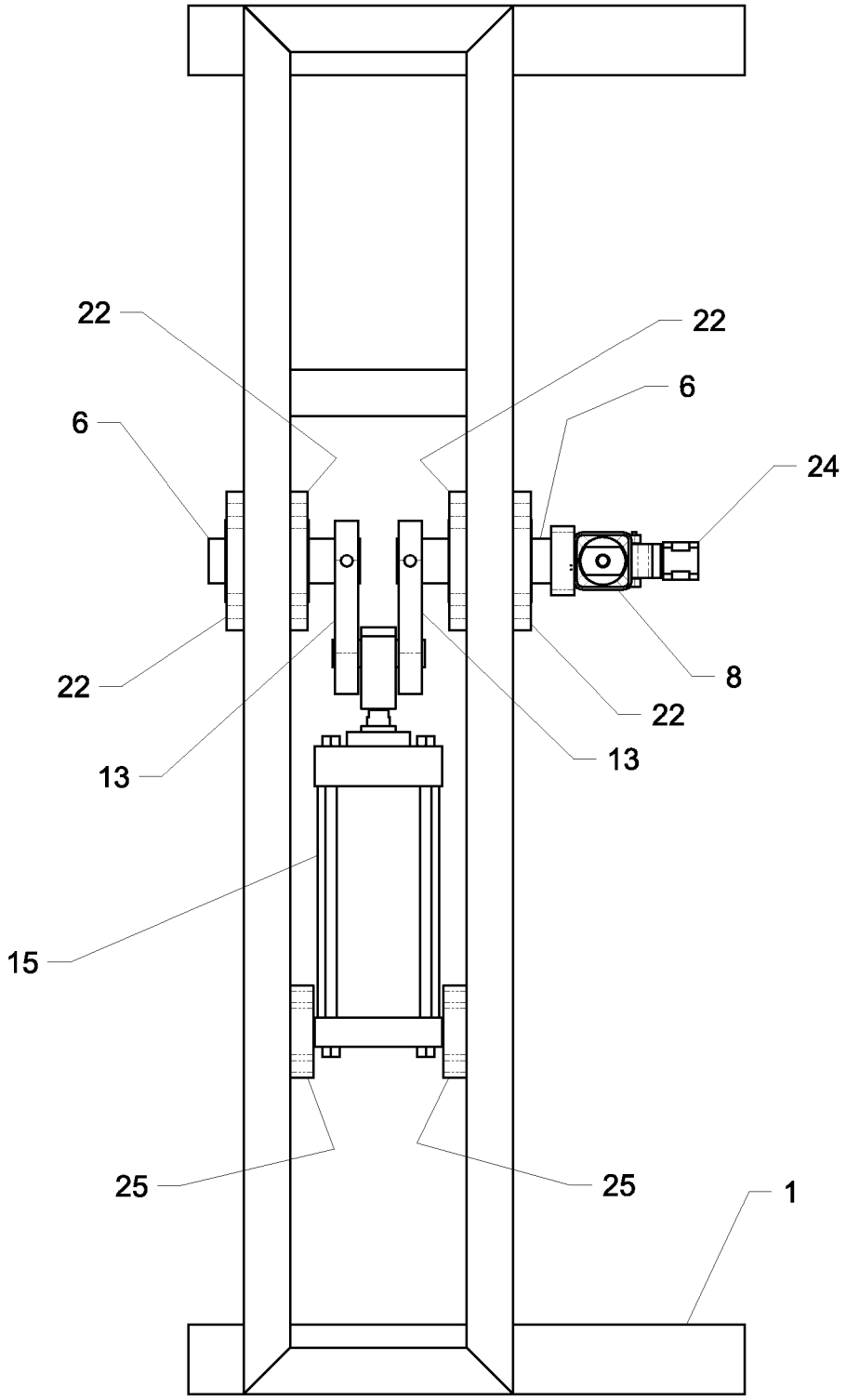
FIG. 6: Top view of present invention smart pneumatic machine with spinning gripper.
Figure 7:
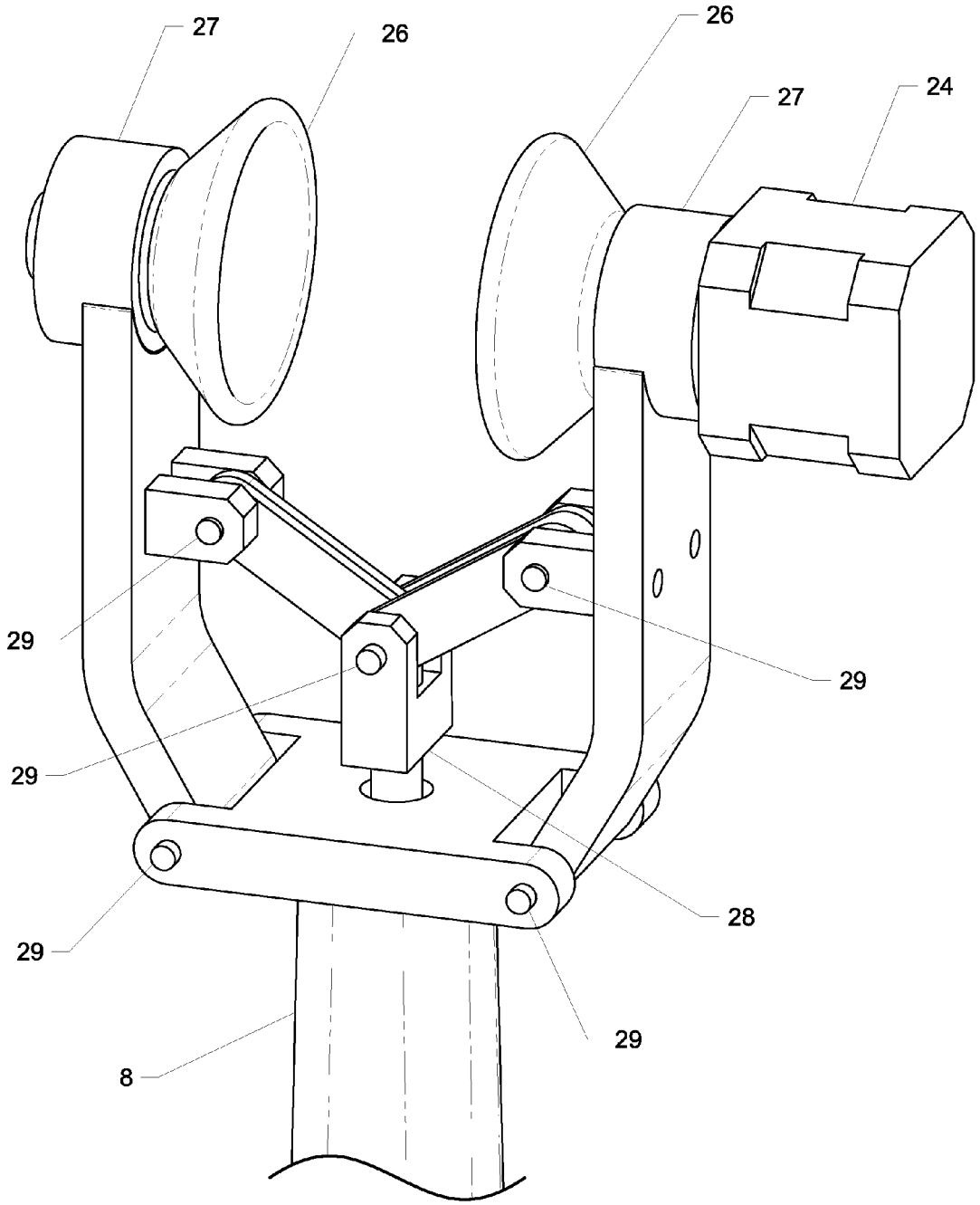
FIG. 7: Enlarged view of present invention, illustrating the, squeezing, spinning ball gripper means.

FIG. 6 is a top view of smart (microprocessor controlled) pneumatic machine with spinning gripper. FIG. 7 is a magnified view, of the squeezing, spinning ball gripper. This is a close up view of the gripper shown in FIG. 5. The ball fits between the conical cups 26, wherein the conical shape centers the ball as it is squeezed. Cups 23 spin freely on ball bearings housed in gripper arms 27. At least one cup 23 is powered by a small reversible variable speed motor 24 to control direction and speed of ball spin. Both gripper arms are squeezed together or pushed apart by mechanical means, such as a control rod 28, which can be powered by an air cylinder, electromagnet, solenoid or similar element, either manually set or automatically controlled by a combination of sensors, microprocessor and resident control system software. Gripper can contain a number of pin joints 29 to convert control rod force to gripping force.

Figure 8:
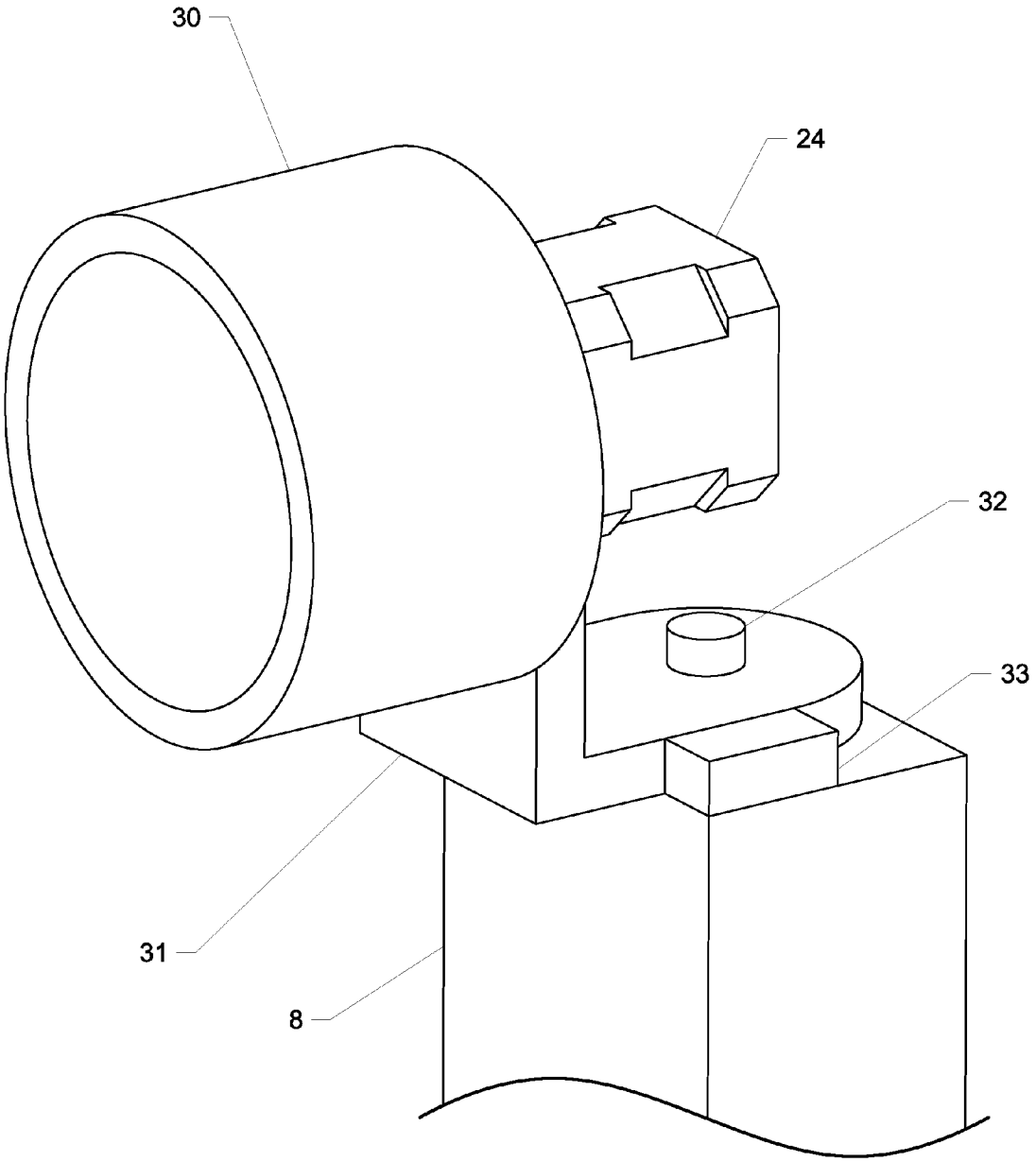
FIG. 8: Perspective view of the present invention embodiment illustrating the ball holder as a spinning conical cup ball grip.
Figure 9:
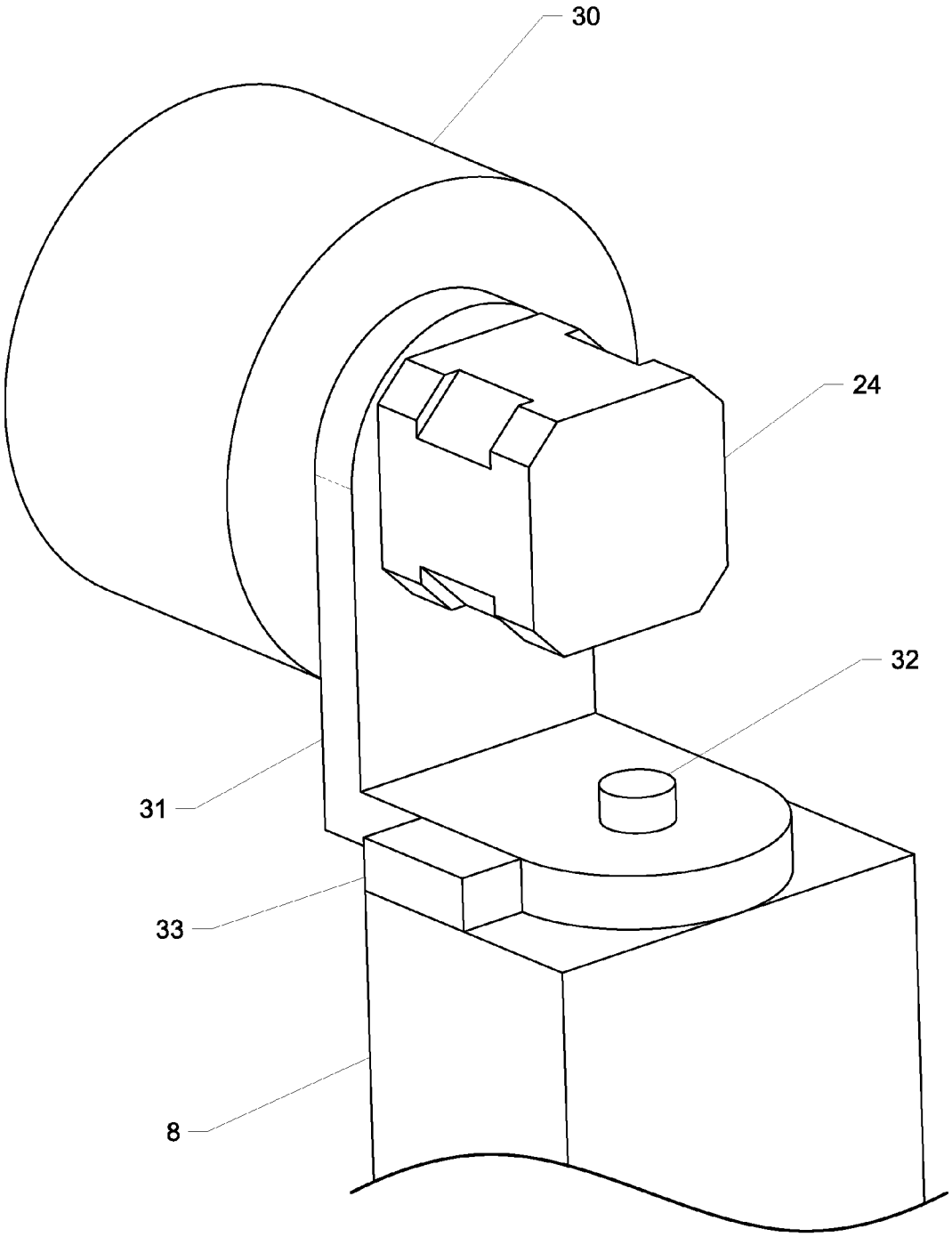
FIG. 9: Secondary view of present invention spinning conical ball cup embodiment.

Conversely the ball holder can also be a single spinning conical cup 26 ball grip, as shown in FIG. 8. The ball is held by friction inside circular shaped cup 30, which centers the ball inside it. The cup 30 is spun by variable speed reversible motor 24. Cup 30 and motor 24 are attached to bracket 31, which pivots on pin 32. Mechanical stop 33 prevents cup from pivoting backwards as the arm accelerates to throw the ball. Bracket 31 is lightly magnetically or spring loaded to rest against stop 33. This keeps the bracket from prematurely pivoting forward from vibrations induced by spinning the ball. As arm 8 begins deceleration, bracket 31 pivots forward from inertia, releasing the pitched ball. See also FIG. 9 for a secondary view.

Figure 10:
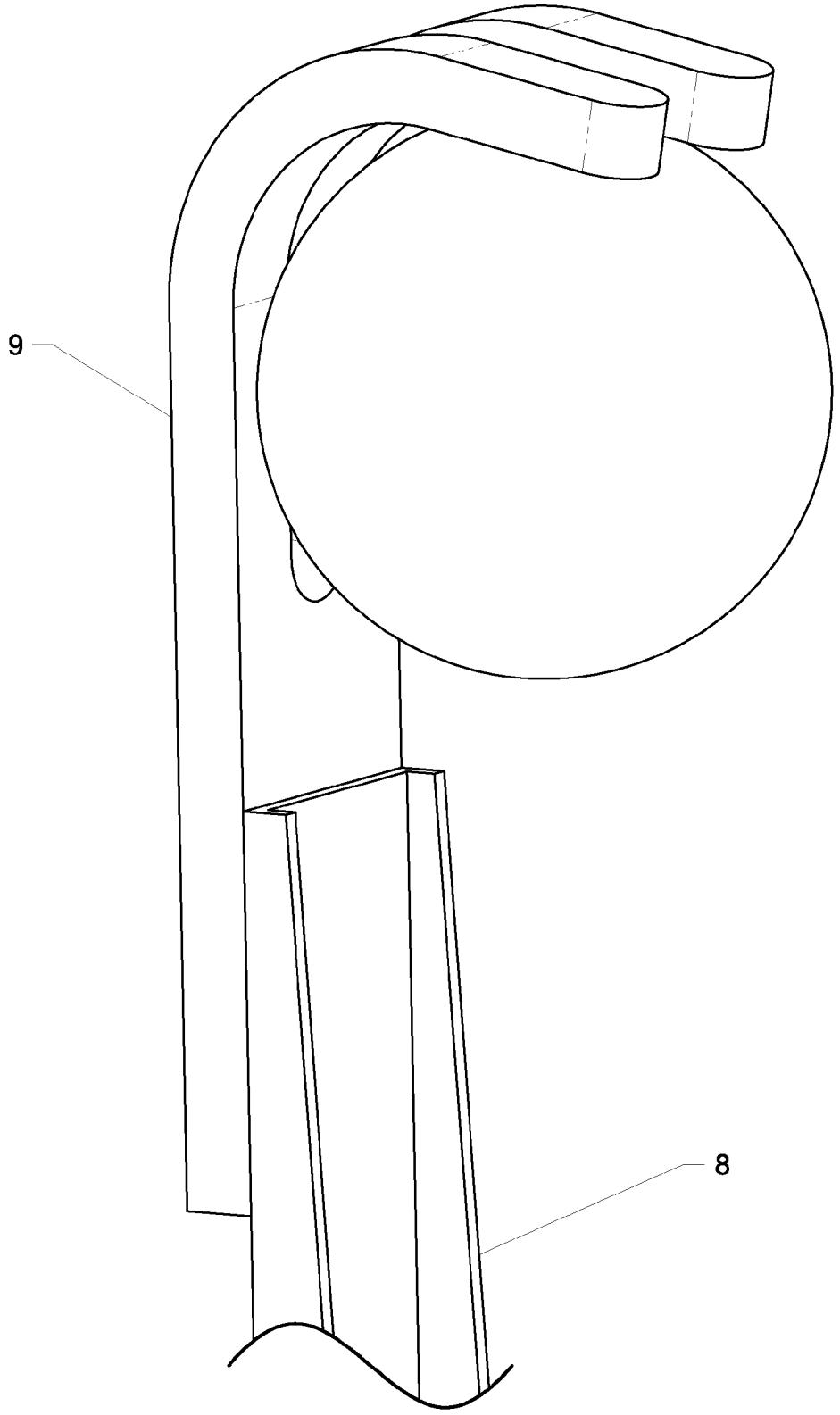
FIG. 10: Magnified view of the present invention passive spin-inducing ball holder.

FIG. 10 discloses the option of a passive spin-inducing ball holder. The close up view of ball holder 9 shows that the fingers wrap around the ball slightly. This creates backspin when the ball is released, as the ball is forced against the fingers from centrifugal force. Fingers may be roughened or otherwise covered with any resilient material to increase friction and resultant spin. For machine embodiments where the ball is loaded with the ball holder upright and gravity would cause it to fall out, a small spring loaded "thumb" or roller can be added. This would hold the ball in place lightly, so that it wouldn't fall out of the holder 9 on its own, but resistive and retaining force is set low enough that it would not significantly impede the ball's release when pitched. The curved or hooked fingers could also be replaced by a resilient pad. As the arm rotates, centrifugal force pushes the ball into the pad, creating the same effect as the hooked fingers and forcing the ball to roll or spin as it is released.

Figure 11:
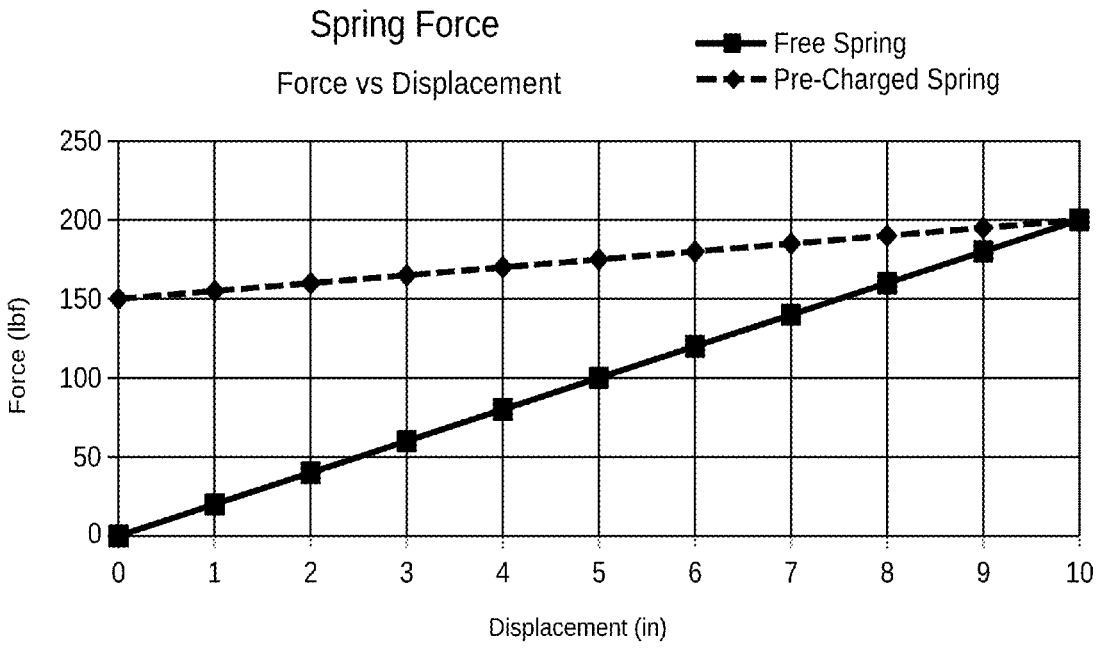
FIG. 11: Chart illustrating the advantage of the present invention using pre-charged springs and air cylinders.

FIG. 11 is a graphical summary of the advantage of using pre-charged springs and air cylinders in the invention. There is a limit to the energy available to power these machines. Operators are limited by their own strength and weight when using foot pedal powered machines, and electric machines are limited by the power available from standard household outlets. In order to make maximum use of the available power, in a preferred embodiment the springs are pre-charged, not free, before they are compressed or expanded. In the example case shown in the graph, the user weighs 200 lbs and can comfortably step 10" up, for a total available energy of 2000 in-lbs (energy=force×displacement). Note that energy stored in the spring is represented by the area under the force/displacement line. If the spring is free before compression, and the user is to use their full weight, they can only add 1000 in-lbs of energy to the system. If the spring is compressed with 150 lbs of force before the user steps on the pedal, they can add 1750 in-lbs of energy into the system. This is because the extra available force (body weight) at the start of compression is essentially wasted if the spring provides no resistance.

This embodiment applies to use of air springs for pitching machines as well. If an air spring is connected to a small reservoir, the pressure will increase significantly as the cylinder 15 is compressed, so the starting pressure must be low, limiting the amount of energy added to the system. When a cylinder 15 connected to a very large reservoir is compressed, the air pressure does not increase. Because of this, the reservoir can start at a much higher pressure, and much more energy can be added to the system for each pitch.

Figure 12:
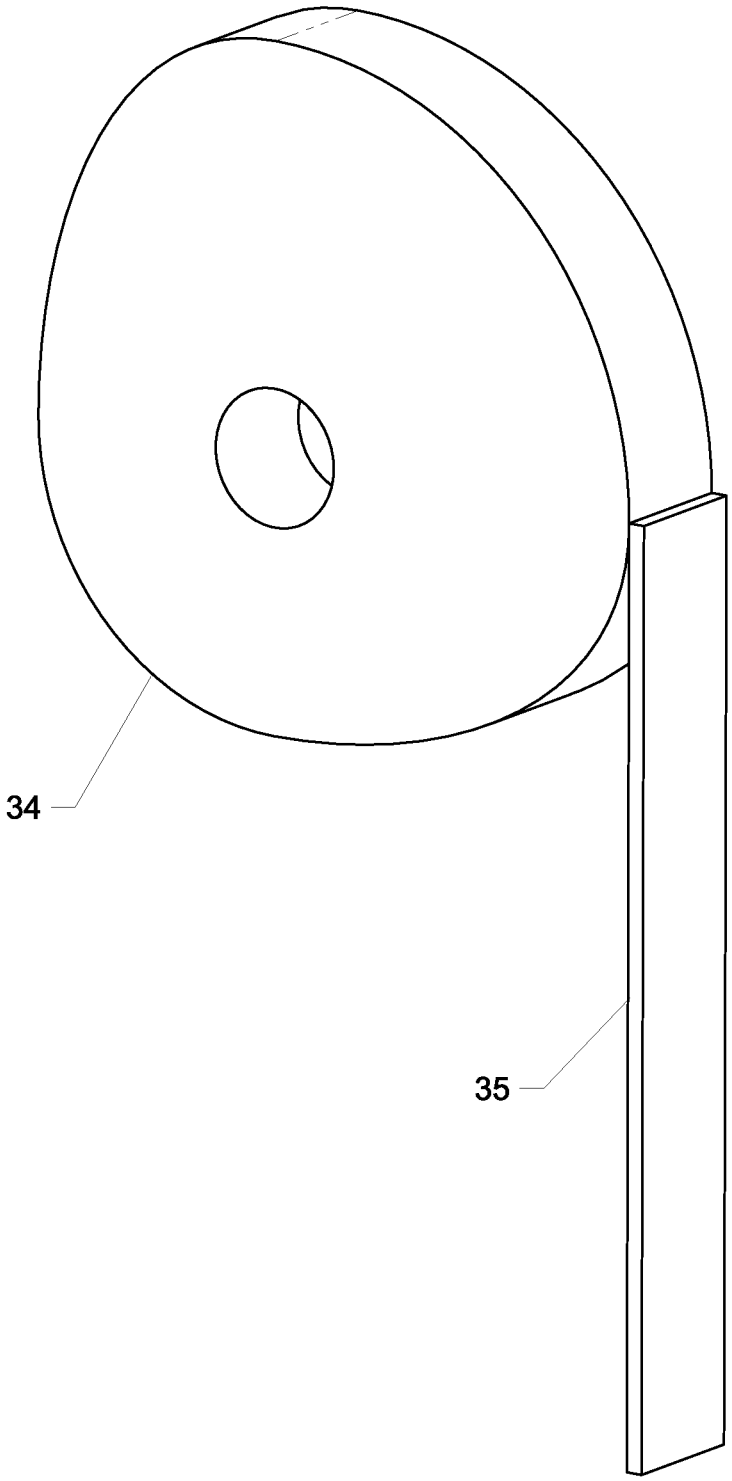
FIG. 12: Enlarged view of the present invention embodiment Cam shaped pulley prior to engagement.
Figure 13:
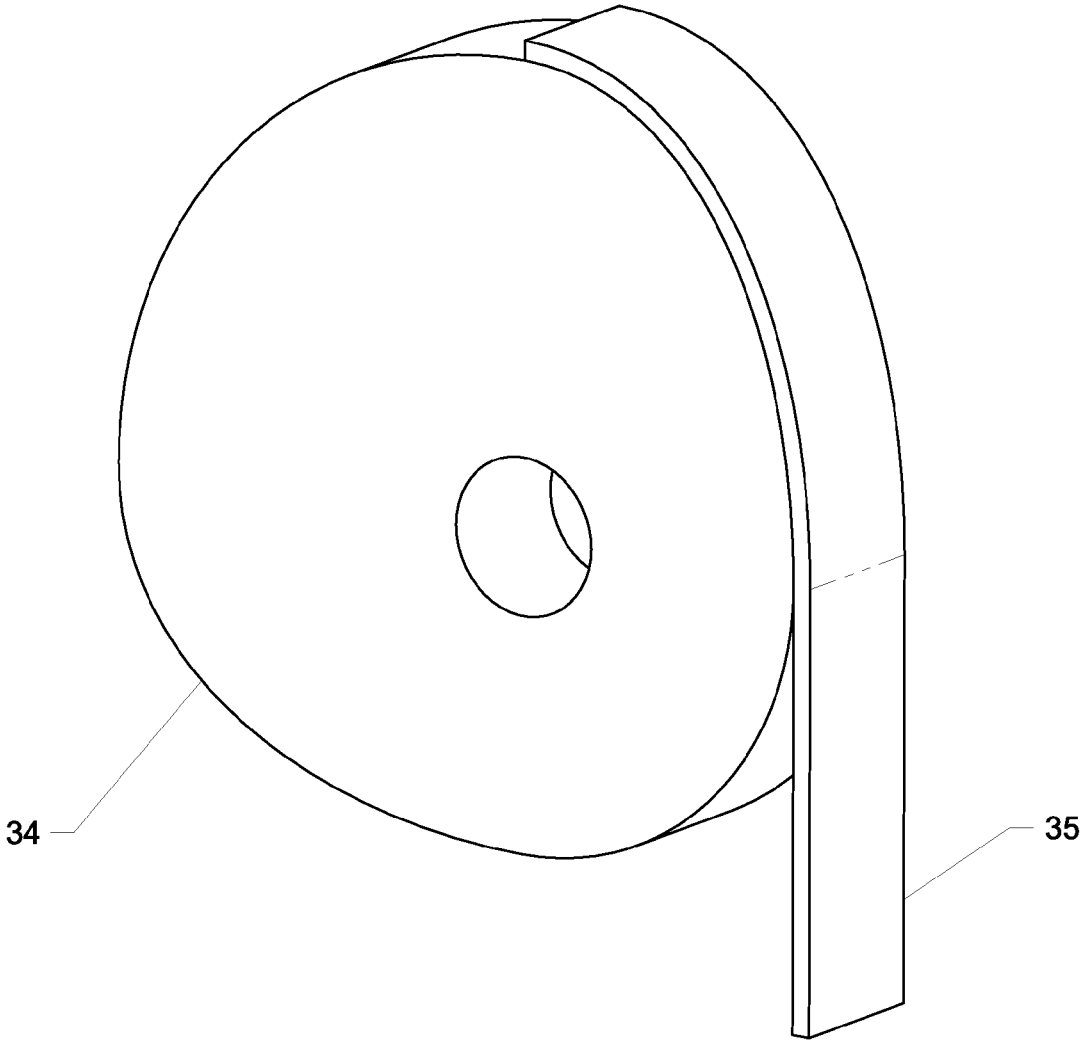
FIG. 13: Enlarged view of the present invention embodiment cam locking pulley after engagement.

FIG. 12 and FIG. 13 are before-and-after views of a cam shaped pulley 34 as a novel means to maximize energy input, not realized in the prior art. Even a pre-charged spring will require more force to compress at the end of its range than at the beginning. An operator is limited by their own body weight which cannot change during the compression. By replacing the standard round pulley with a cam shaped pulley 34 (also meaning a variable radius pulley), the full weight of the user can be input into the system.

In the example shown in FIGS. 12 and 13, the starting pulley radius is larger than the ending radius. So with a constant input torque, the output tension to the belt 35 is increased as the cam rotates.

Figure 14:
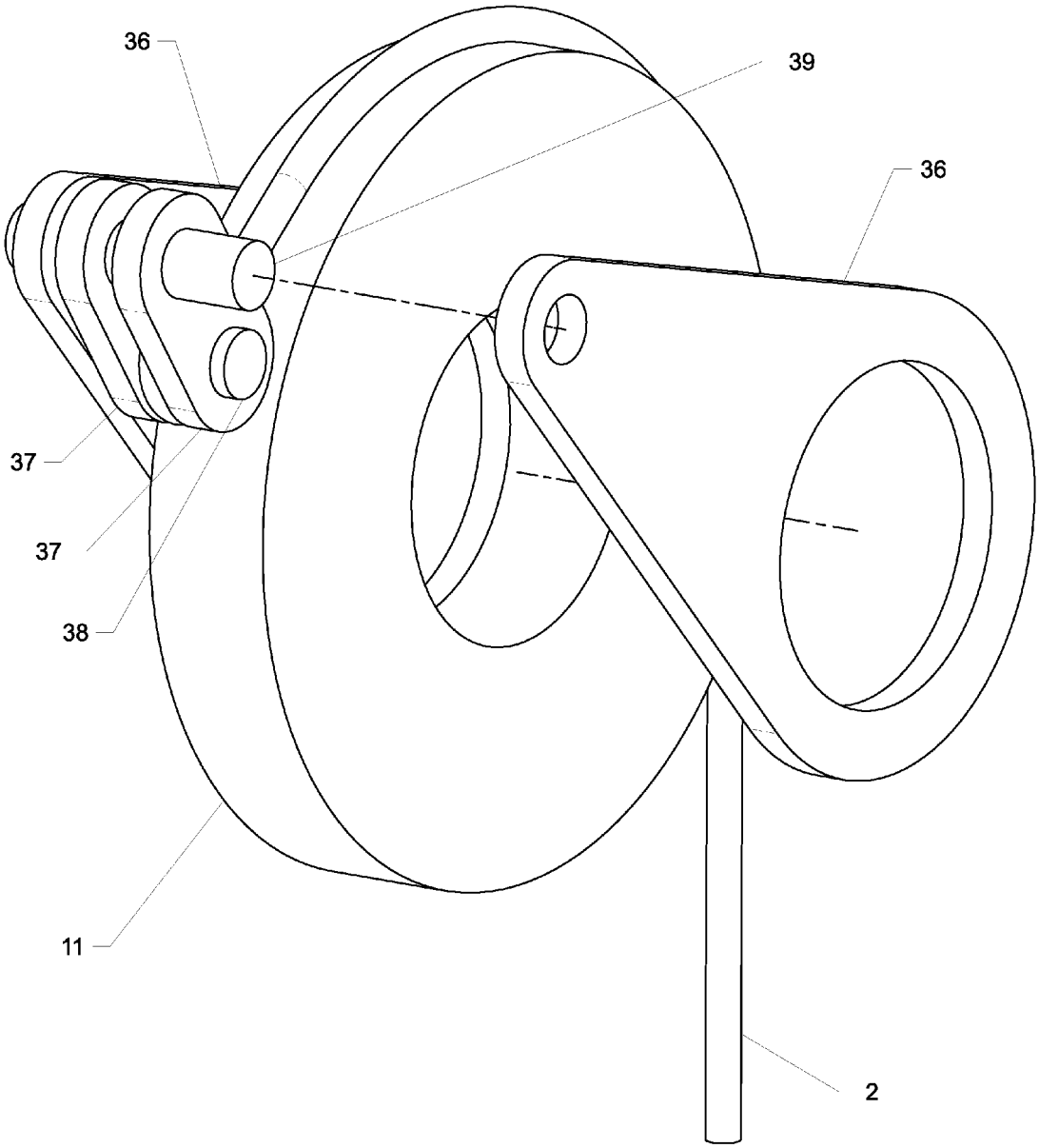
FIG. 14: Enlarged view of cam locking pulley which engages only with cable tension.

FIG. 14 is a detailed view of a cam locking pulley which engages only with cable tension. Two brackets 36 are added to pulley 11, holding cam locks 37 in place. Cable 2 wraps around pulley, and attaches to cam locks 37 via bottom shaft 38. When cable 2 is pulled down by foot pedal 3 (not shown in this view), cam locks 37 rotate counterclockwise on top pin 39, engaging pulley 11, and the entire assembly rotates clockwise. Cam locks 37 are spring biased to rotate away from pulley 11 on pin 39, so they do not touch the pulley unless forced to by cable 2. Brackets 36 are spring loaded to return to starting position after foot pedal 3 is released. As brackets 36 return to starting position, they pull cable 2 and foot pedal 3 back up to starting position as well, leaving pulley 11 in cocked position, ready to throw.

Figure 15:
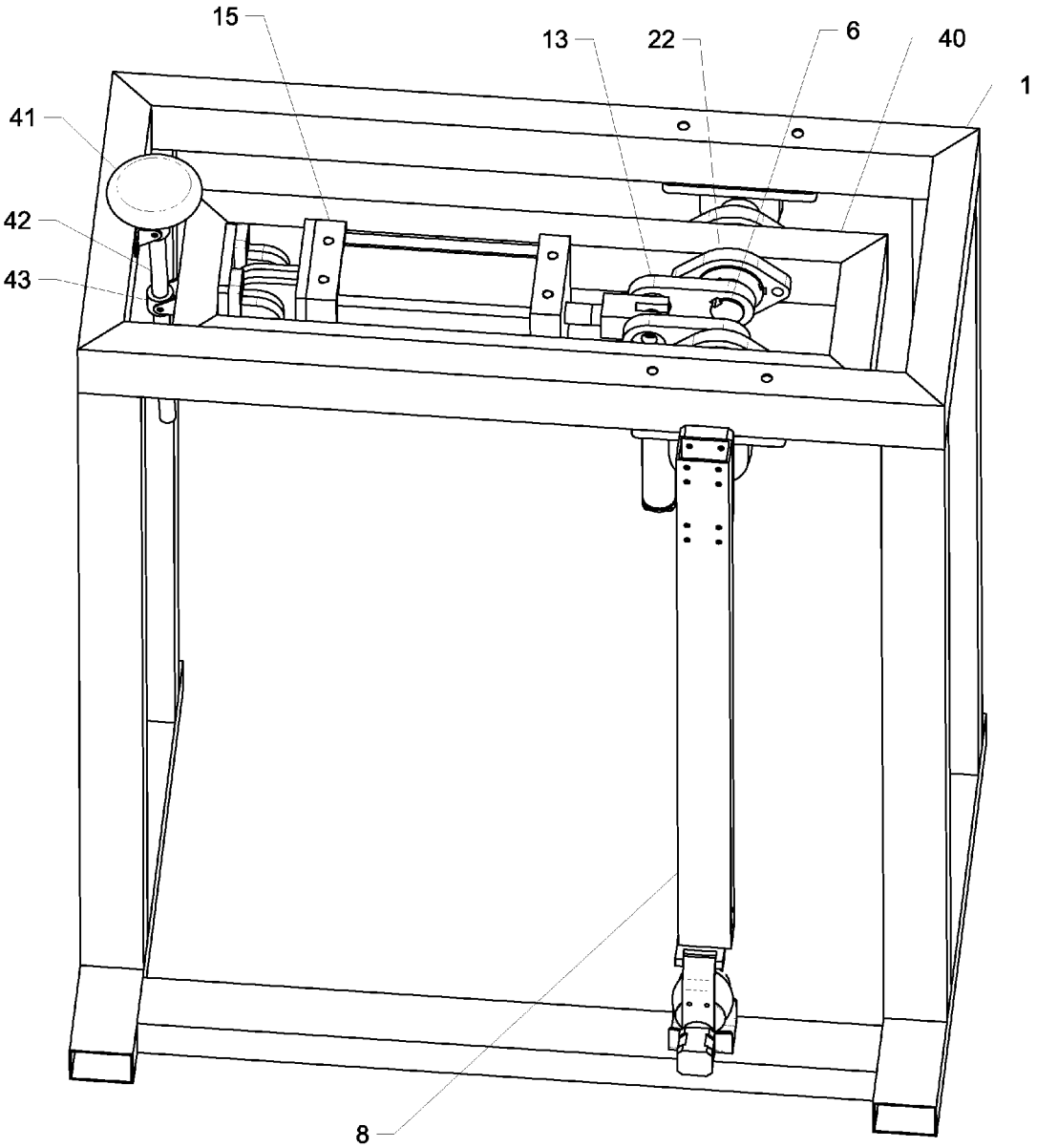
FIG. 15: Perspective view of the present invention embodiment illustrating means and method of adjusting ball release angle by rotating throwing mechanism.

FIG. 15 discloses one of several means of adjusting ball release angle, and thus the vertical location of the pitched ball, by rotating the throwing mechanism. FIG. 15 illustrates an embodiment where vertical ball release angle is controlled by rotating the entire throwing mechanism around the primary arm axis. Throwing mechanism consists of subframe 40, air cylinder 15, crank arms 13, primary arm rotation shafts 6, one way bearings 22, and arm 8. As hand wheel 41 is turned, threaded rod 42 also rotates, moving threaded coupling 43 back and forth. Threaded coupling 43 is attached to subframe 40, so as the hand wheel 41 is turned, subframe 40 and consequently all of the throwing mechanism, are rotated about shafts 6. Because the ball is released as the air cylinder 15 reaches its fully extended position and the mechanism begins to decelerate, rotating the throwing mechanism rotates the ball release point as well. Using a threaded rod 42 that can't be back driven by the torque of the throwing action prevents the release angle from moving on its own. The manual drive wheel 41 can be replaced by a stepper motor to automate this process. The stepper motor may be geared to increase torque and positional accuracy. Other ways to control this angle include a worm drive propelled rod, pushing or pulling one or more corners of the unit around a central support to adjust aim and pitch location vertically as well as horizontally. Another embodiment would be to adjust the amount and direction of spin to control the vertical and horizontal position of the pitched ball.

Figure 16:
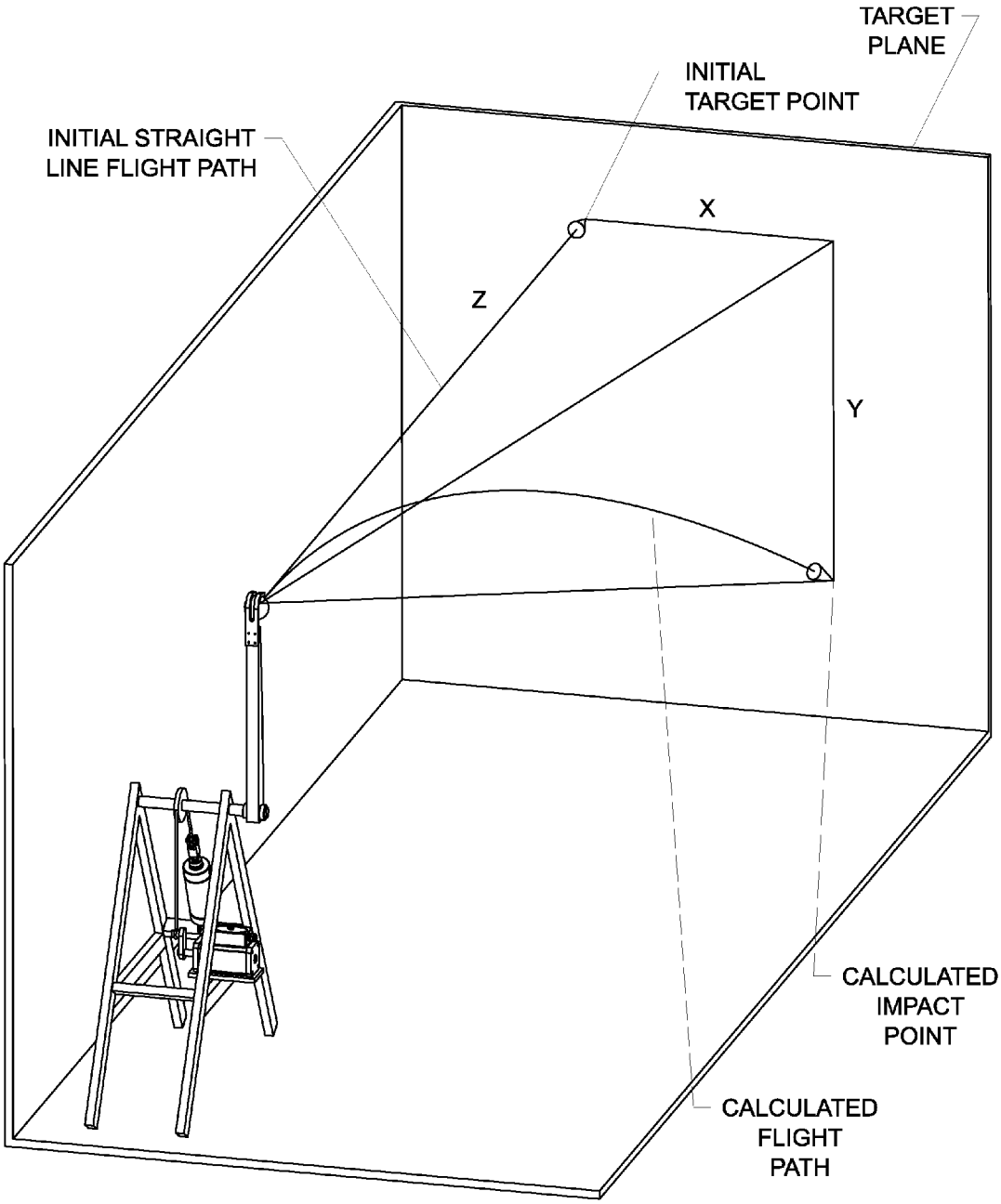
FIG. 16: Perspective view illustrating method and terminology used by software calculation means.

FIG. 16 illustrates the terminology used in the claimed software and microprocessor means for calculating the ball's flight path and aiming the machine, also defined as mathematical formulae. The straight line flight path shows the ball's path if it traveled in a straight line from its release, unaffected by gravity or spin. The calculated flight path arc shows the ball's flight path as predicted by our equations.

The target plane is the vertical plane perpendicular to initial straight line flight path at the target distance, Z. X is the horizontal distance between the ball's calculated impact point and the initial target point. Y is the vertical distance between the ball's calculated impact point and the initial target point.

Figure 17:
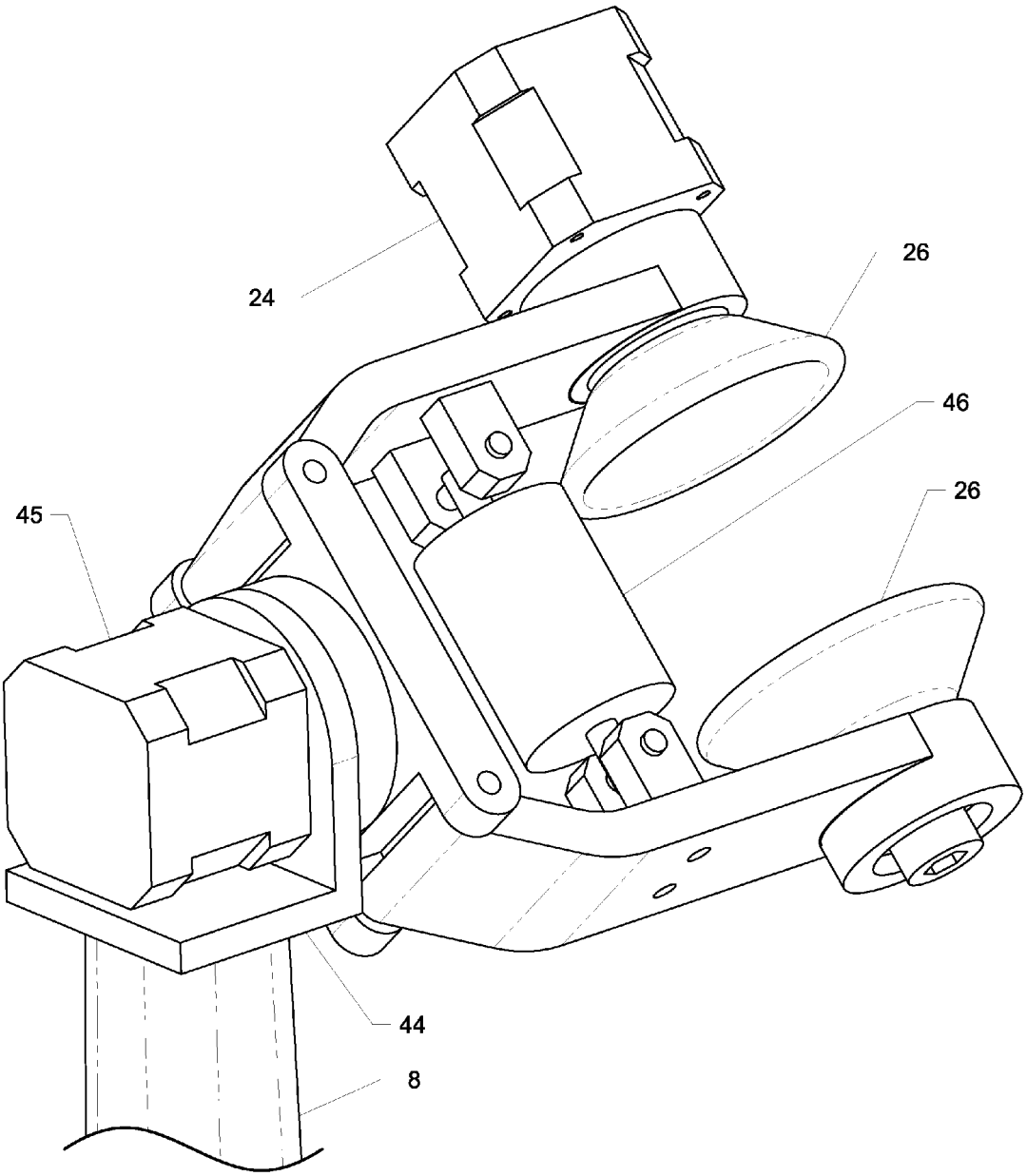
FIG. 17 Perspective enlarged view of the present invention, an embodiment illustrating the rotational ball gripper.

FIG. 17 illustrates an embodiment of the ball gripper that can rotate the ball's axis of rotation by 360 degrees. It differs from the gripper of FIG. 7, in that it has an angle bracket 44 has been added to arm 8. This rotates the orientation of the gripper 90 degrees, so that the gripper "fingers" are now parallel to the ball's pitch direction. The gripper is rotated by gripper rotation motor 45. Because the gripper can now vary the direction of the ball's spin, the machine is capable of throwing balls that curve in any direction. This embodiment also shows a new method of opening and closing the gripper, using an air cylinder 46. This cylinder could easily be replaced with a solenoid or electromagnet.

Figure 18:
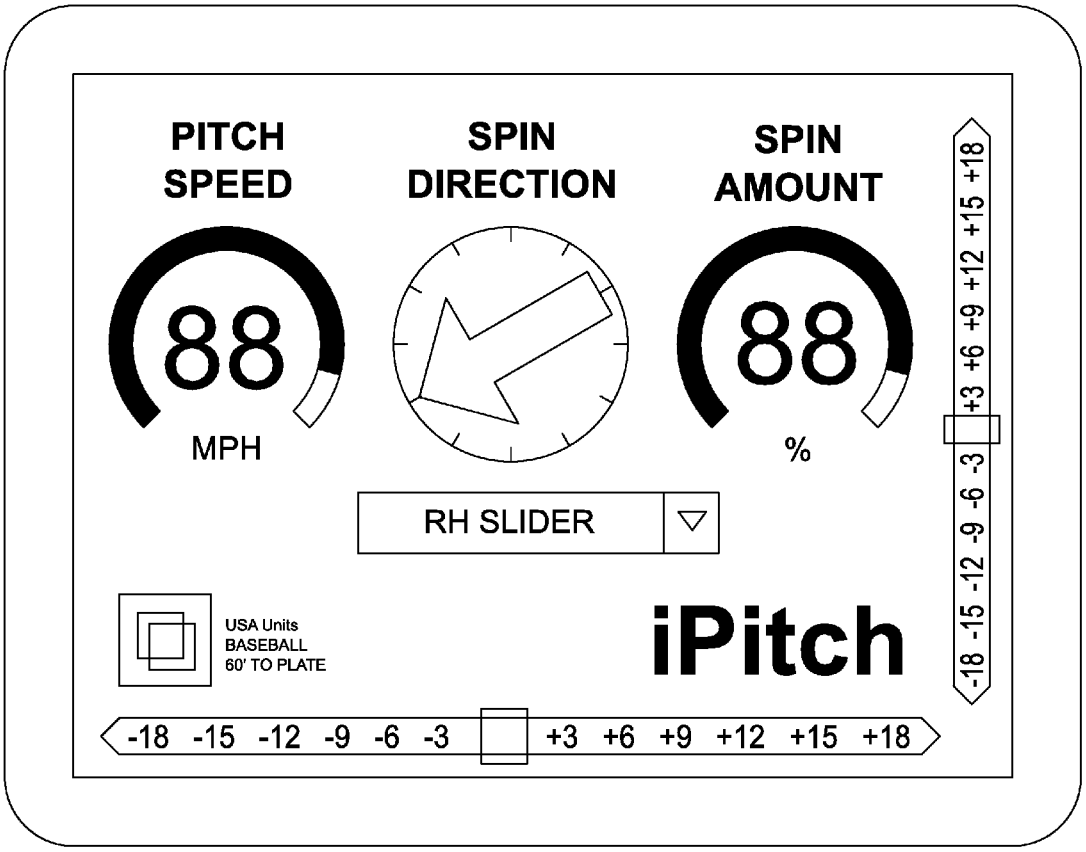
FIG. 18: Illustration of present invention screen view of HMI drop down menu embodiment.
Figure 19:
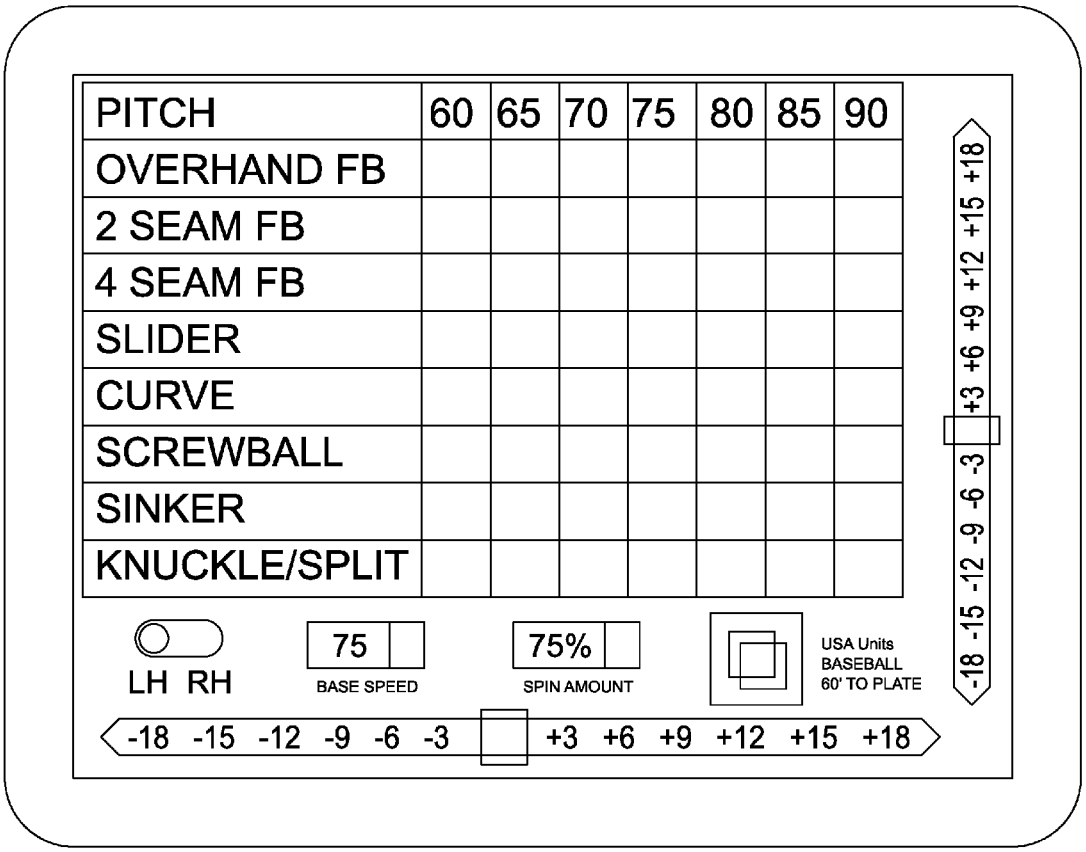
FIG. 19: Illustration of present invention screen viw of HMI percentage of preset standard pitch embodiment.

Included within the scope of the present invention are numerous screen views present on the Human-Machine-Interface (HMI) that provide novel control and reprogramming advantages and means unanticipated by the prior art. FIG. 18: Illustration of present invention screen view of HMI drop down menu embodiment of a specific type of pitch selected, with adjustable speed/direction; FIG. 19 is a screen view of HMI dropdown menu representing a multitude of pitch types such as curveball, slider, fastball, etc. The drop down grid of pitches provides a multitude of pitches which can be selected by single touch. Adjustable touch sensor means allows user to easily input desired speed, percentage of spin normal for a type of pitch, direction of spin and location of pitch. Touchscreen control provides individual widgets for setting pitch speed, spin direction and spin amount. Pitch speed is set directly by adjusting a rotary slider. Units for the pitch speed are selectable by the user under a separate popup menu, typically miles per hour or kilometers per hour.

Ball spin direction is set by either rotating the pointer or by selecting a pitch by name from the dropdown box. The dropdown box and pointer are linked so that adjusting one automatically updates the other. The pointer provides users a graphical means to select a pitch even if they do not what the pitch is called.

Using the coordinates of a clock face, the pitch names for several corresponding directions the arrow is pointing include:

12:00 Overhand fastball
1:00 Right handed 4 seam fastball
2:00 Right handed 2 seam fastball
3:00 Right handed screwball or left handed sidearm curve
4:00 Left handed slider
5:00 Left handed curveball
6:00 Sinker or overhand curve
7:00 Right handed curveball
8:00 Right handed slider
9:00 Left handed screwball or right handed sidearm curve
10:00 Left handed 2 seam fastball
11:00 Left handed 4 seam fastball When the pointer is pointed at angles between these values, the pitch name displayed would match the closest named pitch. These are given as examples. Any choice of reference point yielding different clock coordinates for a given pitch type can be used in the scope and definition of the present invention.

Ball spin amount is set as a percentage of an arbitrary maximum by a rotary slider. This allows users to set the spin amount using a more familiar relative amount (0-100%), instead of directly providing a rotational velocity or RPM, which is not common knowledge.

Horizontal and vertical sliders provide a means for aiming the machine horizontally and vertically. Units of distance are as measured at the target plane, typically the front of home plate.

An additional icon provides users access to a popup window for setting the units for these displays (metric or US), the type of balls being used (baseballs, softballs, cricket, etc.), and the distance to home plate. The values set here are used both for the user interface and for calculating machine aim and spring force.

FIG. 19: Rectangular grid of pitches provides a multitude of pitches which can be selected by single touch. Separate widgets allow user to select the pitching hand, average speed, and spin amount that is applied to all available pitches.

Figure 20:
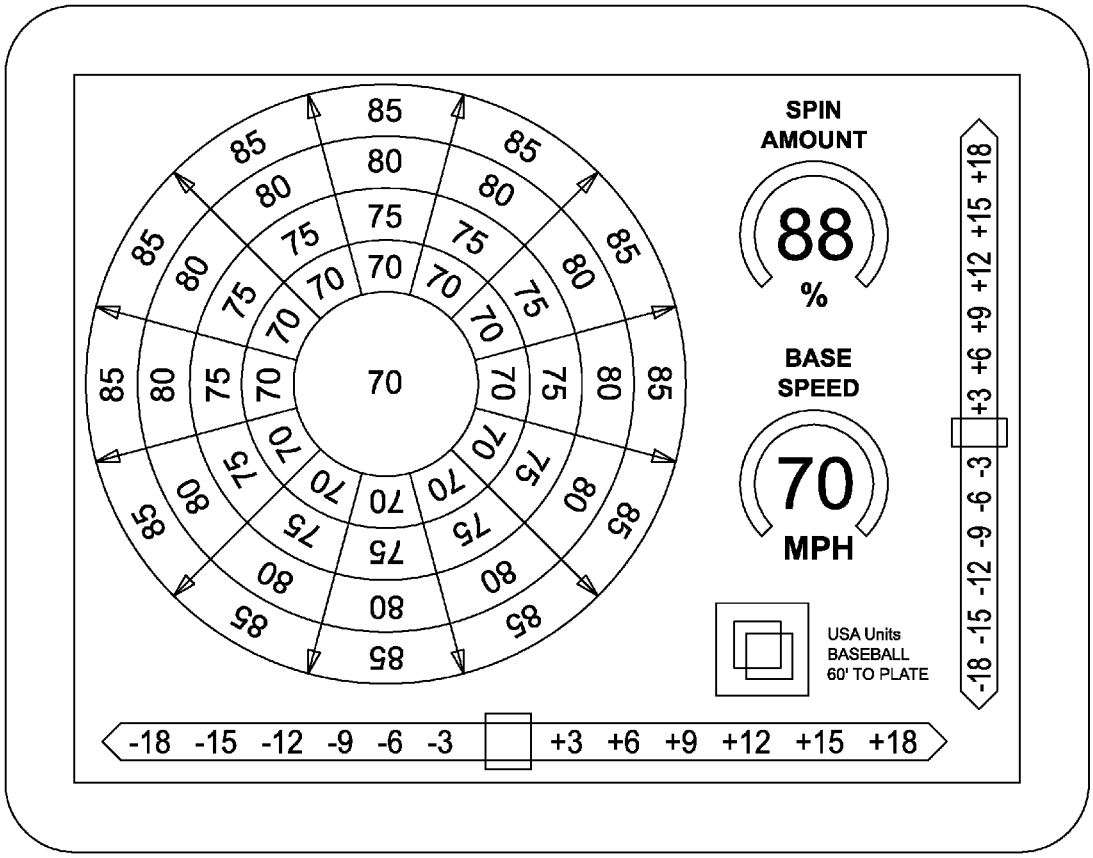
FIG. 20: Illustration of present invention screen view of HMI polar grid embodiment.

FIG. 20: Polar grid of pitches provides a multitude of pitches which can be selected by single touch. Polar layout provides graphical representation of which direction ball will spin and curve. Each segment of the polar display is an active button for selecting that particular speed and ball spin direction. Available speeds are calculated based on a single, user selected base speed. The spin amount setting is user selectable and applied to all pitches. This polar grid layout can be adapted so that pitch speed remains constant throughout, and the concentric rings represent increasing ball spin amounts instead of increasing pitch speeds.

Figure 21:
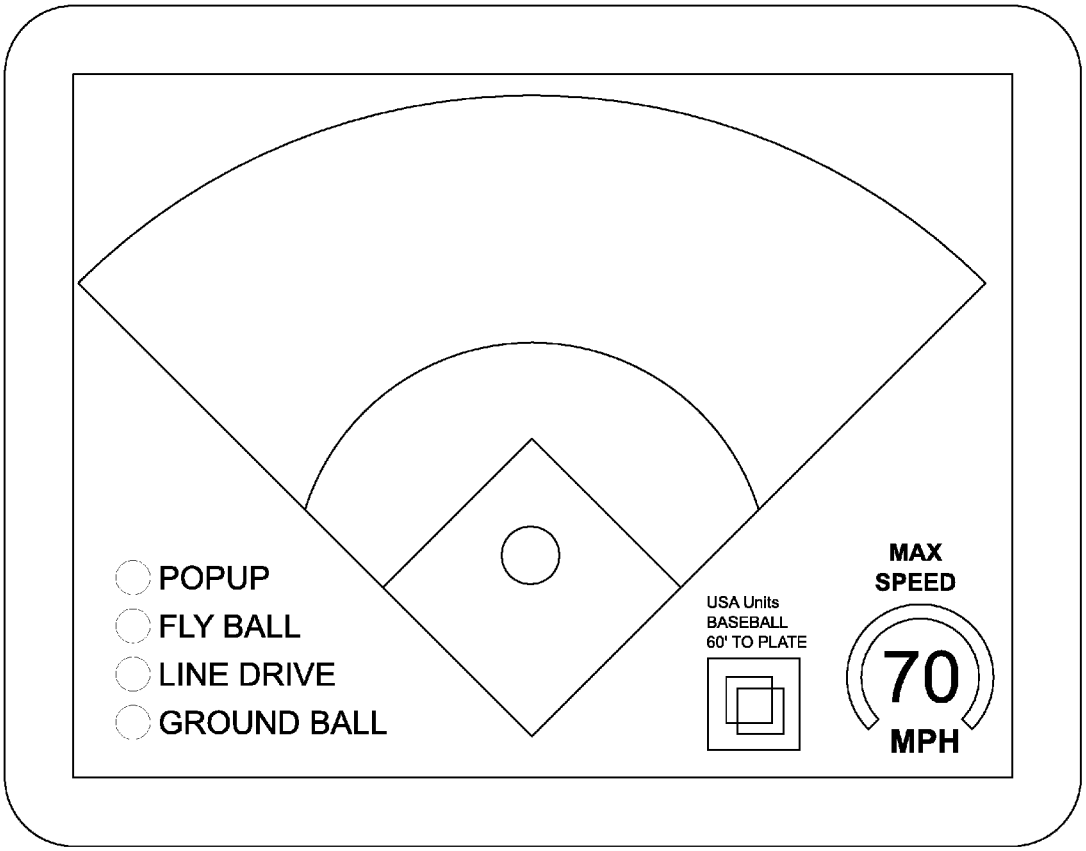
FIG. 21: Illustration of present invention screen view of HMI defensive drill control embodiment.

FIG. 21: The machine is placed at home plate on a ball field, then a single touch sets the machine to automatically throw a ball to the indicated location on the field. User can select ground balls, fly balls, or line drives with a multitude of speeds.

Figure 22:
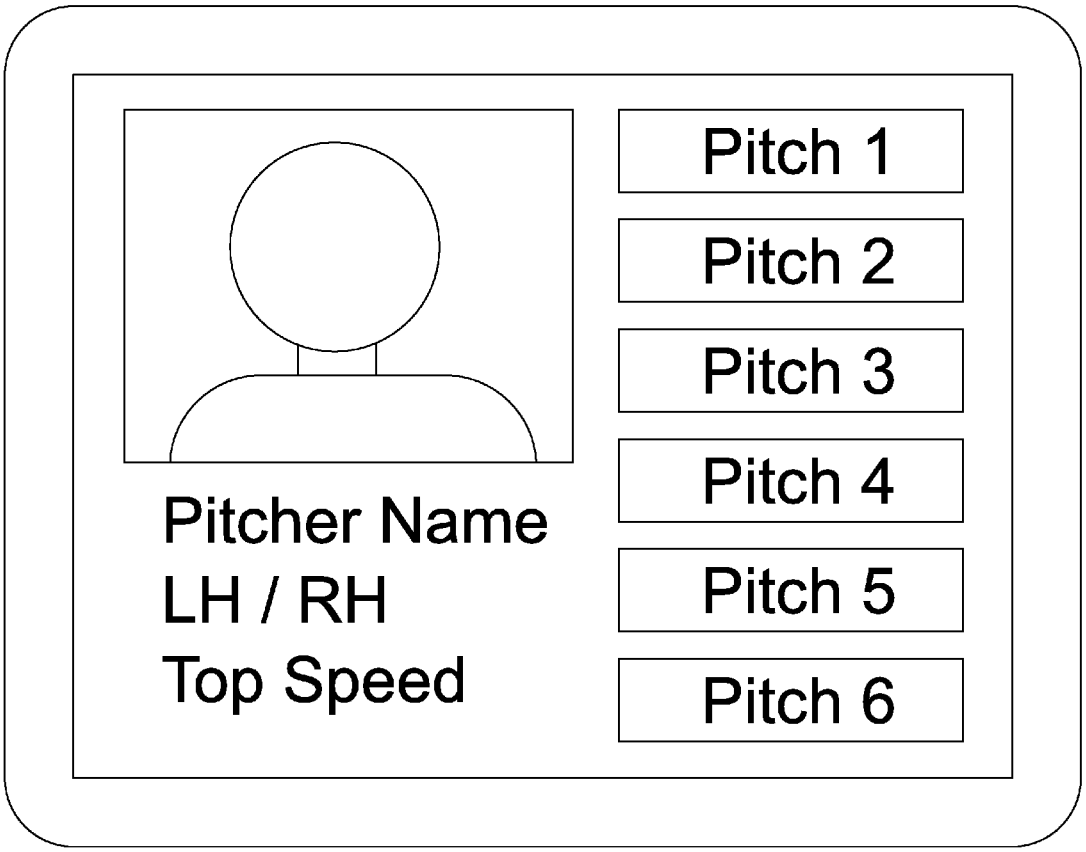
FIG. 22: Illustration of present invention screen view of HMI specific pitcher selection embodiment.

FIG. 22: Specific pitcher screen: Users can create custom pitchers, each with a picture, a top speed, throwing hand, and a set of pitches. Each of these pitches can be customized to exactly match real or fictional pitchers using same parameters as screen shown in FIG. 18—(pitch speed, spin direction, spin amount). Machine can be provided to customer with a library of these pitchers, or users can create their own. Because the machine aim is automatically calculated based on the pitch parameters, the trial and error method of aiming the machine of prior art is eliminated.

The combination software-hardware method for using user input to set up pitch parameters utilizes substantially two constants that will be typically set by the device manufacturer, and up to five user inputs to calculate pitch parameters. The constants include:

STEPSIZE is defined as the number of degrees of machine rotation per each stepper motor step. This value is set by the machine's hardware and depends on the step size and gear ratio of the stepper motors used to aim the machine. For a 200 step per rotation motor with a 47:1 gear ratio, the STEPSIZE equals (360/200)/47=0.0383.

MAXSPIN is the fastest ball spin a user can select. It is an arbitrary value used to simplify user input. An average user may not know what specific RPM they want to spin a ball, but they will understand a relative value of 0-100%. For a MAXSPIN of 3600 RPM, a user selection of 50% would result in a ball spinning at 1800 RPM.

User inputs substantially include any one or more of the following:

PITCHSPEED is the speed of the pitch, in units of miles or kilometers per hour.

Z is the horizontal distance from the ball release point to the target plane, in whole or fractional units of feet or meters.

SPINANGLE is the direction of the ball's spin, in units of degrees, as seen from the batter's view. It is also the direction the ball will curve ignoring gravity. For example, this scale could start at 0 at 12:00 and increases in the clockwise direction as seen from pitcher's view.

SPINAMOUNT % is the amount of ball spin, in units of percent, as a percentage from 0-100%, 100% being equal to the constant MAXSPIN.

C-LIFT is an optional input for the engineering term "coefficient of lift" which correlates the magnus force during flight with ball spin and pitch speed. It provides a way for users to correct the machine's calculations of flight path to account for air density, ball surface quality, ball weight, or wind speed to improve the accuracy of the ball to curve prediction. Units of in/(s^2*RPM*mph^2).

Arithmetic formulae calculations within the software are as follows:

SPINAMOUNT-RPM=SPINAMOUNT-%*MAXSPIN//converts spin amount from percentage value to an absolute value. Units of RPM.

ACC-*X*=sin(SPINANGLE)*SPINAMOUNT-RPM*CLIFT*PITCHSPEED^2//calculates horizontal acceleration of pitched ball. For example, in units of in/s^2.

ACC-*Y*=cos(SPINANGLE)*SPINAMOUNT-RPM*CLIFT*PITCHSPEED^2−386.4//calculates vertical acceleration of pitched ball including gravity. For example in units of in/s^2.

*T*=*Z*/(1.4667*PITCHSPEED)//calculated time of ball flight. In units of seconds.

*X*=0.5*ACC-*X**T*^2//horizontal displacement of ball during flight from magnus force. For example in units of inches.

*Y*=0.5*ACC-*Y**T*^2//vertical displacement of ball during flight from magnus force and gravity. For example, in units of inches.

ANG-*X*=ARCTAN(*X*/(*Z**12))//angle of horizontal displacement of ball during flight from magnus force. For example, in units of degrees.

ANG-*Y*=ARCTAN(*Y*/(*Z**12))//angle of horizontal displacement of ball during flight from magnus force. Units of degrees.

*X*STEP=INTEGER(ANG-*X*/STEPSIZE+0.5)//number of horizontal steps to rotate machine ANG-*X* degrees.

*Y*STEP=INTEGER(ANG-*Y*/STEPSIZE+0.5)//number of vertical steps to rotate machine ANG-*Y* degrees.

Algorithm for aiming machine:

1) TAKE USER INPUT FOR NEW PITCH
2) CALCULATE XSTEP AND YSTEP
3) COMPARE XSTEP AND YSTEP TO PREVIOUS VALUES
4) MOVE MACHINE THE DIFFERENCE
5) ADJUST RELEASE POINT IF NECESSARY TO ACHIEVE DESIRED VERTICAL LOCATION

This results in all pitches being thrown in same location. Machine can be aimed outside of this process to change pitch location as well, and remain within the scope of the invention.

PITCHSPEED is used to calculate either air spring pressure or mechanical spring displacement from an empirically derived equation.

SPINAMOUNT-RPM is used to drive ball spinner motor 24 at that RPM.

SPINANGLE is used to position gripper rotating motor 45, setting ball spin angle directly.

While any of the above calculated or input values may be listed in English or Metric units, it is understood any unit of measurement, whether whole or fractional, and any alternative tag name for any variable listed above, would still remain within the scope of the claims of this invention.

Any combination of any of the above said manual adjustments or operations can furthermore be automated via a combination of devices such as sensors means such as photo-eyes, microswitches and proximity switches, data processing means such as a microprocessor accessing data provided by the sensors and a human-machine interface, utilizing resident algorithms in the form of firmware or software in calculating necessary adjustments on the machine and converting those calculated values into signals to motive means such as servo, stepper or gear motors or air or pneumatic cylinders or air springs, and remain in the scope and intent of the subject invention.

Thus, although there have been described particular embodiments of the present disclosure of a new and useful SPIN INDUCING ARM PITCHING MACHINE, it is not intended that such references be construed as limitations upon the scope of this disclosure except as set forth in the following claims.

The invention claimed is:

1. A ball-throwing machine including means to interchangeably deliver a ball with pitches of at least one type to different locations, said machine comprising:

a frame;

a shaft rotatably connected to the frame, wherein the shaft has a first angular orientation relative to the frame and a second angular orientation relative to the frame;

an actuator operatively connected to the shaft, wherein the actuator rotates the shaft from the first angular orientation to the second angular orientation with a rotational speed;

an arm fixedly connected to the shaft at a proximal end and extending for a distance to a distal end, wherein the arm has a first position corresponding with the first angular orientation of the shaft and is rotated by the rotational speed to a second position corresponding with the second angular position of the shaft; and a ball holder connected to the distal end of the arm, wherein the ball holder comprises a gripping means for imparting spin on the ball as the arm is moved from its first position to the second position, wherein the gripping means is at least one of a curved gripper and a cup gripper, wherein the curved gripper comprises at least one hooked finger partially wrapped around the ball, wherein the cup gripper comprises at least one of a conical cup and a cylindrical cup, wherein an actuator moves the conical cup relative to another conical cup, and wherein the cylindrical cup pivots on a pin.

2. The ball-throwing machine of claim 1, wherein the arm is greater than 18" in length.

3. The ball-throwing machine of claim 1, further comprising a controller, wherein the controller adjusts the rotational speed of the arm and is further comprised of a component selected from the group of components consisting of:

a) at least one motor and a drive control, b) means for rapidly changing the speed of each arm;

c) at least one air cylinder;

d) at least one spring;

e) a human-powered foot pedal; and f) a human-power lever; and wherein the arm has a construction selected from the group of constructions consisting of:

a) a one-piece construction from the shaft to the ball holder; and b) a multi-piece construction comprising at least one mechanical joint means between the shaft and the ball holder.

4. The ball-throwing machine of claim 1, wherein the curved gripper is further comprised of a pair of substantially hooked fingers wrapped around the ball, wherein a proximal end of the hooked fingers contact the ball at a first location and wherein a more distal section of the substantially hooked fingers contact the ball at a second location.

5. The ball-throwing machine of claim 1, further comprising a spinning motor operatively engaging with the gripping means when the arm is at least in the first position, wherein the gripping means is a cup shaped appendage, and wherein the spinning motor rotates the gripping means.

6. The ball-throwing machine of claim 5, wherein the spinning motor is connected to the cup shaped appendage.

7. The ball-throwing machine of claim 6, wherein the gripping means further comprises at least one of a control rod, a plurality of pin joints, an air cylinder, a solenoid, and a rotation motor, wherein the rotation motor rotatably connects the cup shaped appendage to the distal end of the arm and moves the cup shaped appendage between a range of orientations relative to the arm, wherein the cup shaped appendage is at least one of a cylindrically shaped cup and a pair of opposing conically shaped cups, wherein the control rod acts on the pin joints to vary a space between the pair of opposing conically shaped cups, and wherein at least one of the air cylinder and the solenoid vary the space between the pair of opposing conically shaped cups.

8. The ball-throwing machine of claim 1, further comprising a programmable controller in operative communication with the actuator, wherein the actuator is further comprised of a motor with a drive control.

9. The ball-throwing machine of claim 8, wherein the programmable controller further comprises a programmable microprocessor.

10. The ball-throwing machine of claim 9, further comprising a user interface in operative communication with the programmable microprocessor, wherein the user interface is at least one of a software application on a portable wireless device and a machine-mounted human-machine interface.

11. The ball-throwing machine of claim 10, wherein the human machine interface is further comprised of a graphical interface, wherein the graphical interface is comprised of a pitch speed indicator, a ball spin direction indicator, and a ball spin amount indicator, wherein the ball spin direction indicator is shown in a polar arrangement with a plurality of optional ball spin directions and a rotating directional indicator identifying a selected one of the optional ball spin directions, and wherein the ball spin direction indicator is separate from the ball speed shown on the pitch speed indicator and the ball spin shown on the ball spin amount indicator.

12. The ball-throwing machine of claim 1, wherein a direction of rotation for the arm is reversed enabling the machine to pitch underhand.

13. The ball-throwing machine of claim 1, further comprising a programmable controller in operative communication with the actuator and a spinning motor operatively engaging with the gripping means, wherein the gripping means is comprised of a pair of opposing conically shaped cups and a squeezing actuator, wherein the spinning motor rotates at least one of the pair of opposing conically shaped cups, the squeezing actuator compresses the pair of opposing conically shaped cups on the ball during the throwing motion opens the pair of opposing conically shaped cups and releases the ball at an arm location between the first position and the second position as determined by the programmable controller and communicated to the squeezing actuator.

14. The ball-throwing machine of claim 1 further comprising a human machine interface comprised of a graphical interface, wherein the graphical interface is comprised of a pitch speed indicator, a ball spin direction indicator, and a ball spin amount indicator, wherein the ball spin direction indicator is shown in a polar arrangement with a plurality of optional ball spin directions and a rotating directional indicator identifying a selected one of the optional ball spin directions, and wherein the ball spin direction indicator is separate from the ball speed shown on the pitch speed indicator and the ball spin shown on the ball spin amount indicator.

15. A ball-throwing machine for propelling a ball toward a batter to simulate a pitch, comprising:

a frame;

an actuator connected to the frame;

an arm connected to the actuator at a proximal end and extending for a distance to a distal end, wherein the actuator rotates the arm by a rotational speed from a first position to a second position;

a ball holder connected to and extending from the distal end of the arm, wherein the ball holder further comprises a cup shaped appendage;

a spinning motor connected to the ball holder and operatively engaging with the cup shaped appendage, wherein the spinning motor rotates the cup shaped appendage; and a programmable controller in operative communication with the actuator and the spinning motor; and a human-machine interface in operative communication with the programmable controller, wherein the human-machine interface is at least one of a software application on a portable wireless device and a machine-mounted human-machine interface.

16. The ball-throwing machine according claim 15, wherein the programmable controller sends a first signal to the actuator to vary the rotational speed and sends a second signal to the spinning motor to rotate the cup shaped appendage at a spinner speed.

17. The ball-throwing machine according claim 15, wherein the arm has a length greater than 18" between the proximal end and the distal end.

18. The ball-throwing machine according claim 17, wherein the cup shaped appendage is located beyond the distal end of the arm by a distance past the length of the arm to provide a space sufficient to grip the ball.

19. The ball-throwing machine according claim 15, wherein the ball holder further comprises at least one of a control rod, a plurality of pin joints, an air cylinder, a solenoid, and a rotation motor, wherein the rotation motor rotatably connects the cup shaped appendage to the distal end of the arm and moves the cup shaped appendage between a range of orientations relative to the arm, wherein the cup shaped appendage is at least one of a cylindrically shaped cup and a pair of opposing conically shaped cups, wherein the control rod acts on the pin joints to vary a space between the pair of opposing conically shaped cups, and wherein at least one of the air cylinder and the solenoid vary the space between the pair of opposing conically shaped cups.

20. The ball-throwing machine according claim 15, wherein the human machine interface is further comprised of a graphical interface, wherein the graphical interface is comprised of a pitch speed indicator, a ball spin direction indicator, and a ball spin amount indicator, wherein the ball spin direction indicator is shown in a polar arrangement with a plurality of optional ball spin directions and a rotating directional indicator identifying a selected one of the optional ball spin directions, and wherein the ball spin direction indicator is separate from the ball speed shown on the pitch speed indicator and the ball spin shown on the ball spin amount indicator.

21. The ball-throwing machine according claim 15, further comprising a shaft, wherein the shaft is rotatably connected to at least one of the frame and the actuator, wherein the arm is connected to the actuator through a fixed connection between the shaft and the proximal end of the arm, wherein the shaft has a first angular orientation relative to the frame and a second angular orientation relative to the frame, and wherein the actuator rotates the shaft from the first angular orientation to the second angular orientation with the rotational speed.

22. A ball-throwing machine for propelling a ball toward a batter to simulate a pitch, comprising:

a frame;

an actuator connected to the frame;

an arm connected to the actuator at a proximal end and extending for a distance to a distal end, wherein the actuator rotates the arm by a rotational speed from a first position to a second position;

a ball holder connected to and extending from the distal end of the arm, wherein the ball holder further comprises a gripper with an appendage having a curvature corresponding with a shape of the ball;

a programmable controller in operative communication with the actuator; and a human-machine interface in operative communication with the programmable controller, wherein the human-machine interface is further comprised of a graphical interface, wherein the graphical interface is at least one of a software application on a portable wireless device and a machine-mounted human-machine interface, wherein the graphical interface is comprised of a pitch speed indicator, a ball spin direction indicator, and a ball spin amount indicator, wherein the ball spin direction indicator is shown in a polar arrangement with a plurality of optional ball spin directions and a rotating directional indicator identifying a selected one of the optional ball spin directions, and wherein the ball spin direction indicator is separate from the ball speed shown on the pitch speed indicator and the ball spin shown on the ball spin amount indicator.

23. The ball-throwing machine according to claim 22, wherein the arm has a length greater than 18" between the proximal end and the distal end.

24. The ball-throwing machine according to claim 22, wherein the appendage of the gripper is comprised of a pair of hooked fingers.

25. The ball-throwing machine according to claim 22, wherein the appendage of the gripper is further comprised of a cup shaped appendage.

26. The ball-throwing machine according to claim 25, further comprising a spinning motor connected to the ball holder, wherein the spinning motor operatively engages with and rotates the cup shaped appendage, wherein the programmable controller is in operative communication with the spinning motor, and wherein the programmable controller sends a first signal to the actuator to vary the rotational speed and sends a second signal to the spinning motor to rotate the cup shaped appendage at a spinner speed.

27. The ball-throwing machine according to claim 26, wherein the ball holder further comprises at least one of a control rod, a plurality of pin joints, an air cylinder, a solenoid, and a rotation motor, wherein the rotation motor rotatably connects the cup shaped appendage to the distal end of the arm and moves the cup shaped appendage between a range of orientations relative to the arm, wherein the cup shaped appendage is at least one of a cylindrically shaped cup and a pair of opposing conically shaped cups, wherein the control rod acts on the pin joints to vary a space between the pair of opposing conically shaped cups, and wherein at least one of the air cylinder and the solenoid vary the space between the pair of opposing conically shaped cups.

28. A ball-throwing machine for propelling a ball toward a batter to simulate a pitch, comprising:

a frame;

an actuator connected to the frame;

an arm connected to the actuator at a proximal end and extending for a distance to a distal end, wherein the actuator rotates the arm by a rotational speed from a first position to a second position, and wherein the arm has a length greater than 18" between the proximal end and the distal end;

a programmable controller in operative communication with the actuator, wherein the programmable controller sends a first signal to the actuator to vary the rotational speed; and a ball holder connected to and extending from the distal end of the arm, wherein the ball holder further comprises a gripper with an appendage having a curvature corresponding with a shape of the ball.

29. The ball-throwing machine according to claim 28, wherein the appendage of the gripper is selected from the group of appendages consisting of a pair of hooked fingers, a cylindrically shaped cup, and a pair of opposing conically shaped cups, and wherein the appendage is located beyond the distal end of the arm by a distance past the length of the arm to provide a space sufficient to grip the ball.

30. The ball-throwing machine according to claim 28, further comprising a spinning motor connected to the ball holder and operatively engaging with the appendage of the gripper, wherein the appendage is a cup shaped appendage, wherein the spinning motor rotates the cup shaped appendage, wherein the programmable controller is in operative communication with the spinning motor, and wherein the programmable controller sends a second signal to the spinning motor to rotate the cup shaped appendage at a spinner speed.

31. The ball-throwing machine according to claim 28, further comprising a human-machine interface in operative communication with the programmable controller, wherein the human-machine interface is further comprised of a graphical interface, wherein the graphical interface is at least one of a software application on a portable wireless device and a machine-mounted human-machine interface, wherein the graphical interface is comprised of a pitch speed indicator, a ball spin direction indicator, and a ball spin amount indicator, wherein the ball spin direction indicator is shown in a polar arrangement with a plurality of optional ball spin directions and a rotating directional indicator identifying a selected one of the optional ball spin directions, and wherein the ball spin direction indicator is separate from the ball speed shown on the pitch speed indicator and the ball spin shown on the ball spin amount indicator.

* * * * *